US010827791B2

(12) United States Patent
Banta

(10) Patent No.: US 10,827,791 B2
(45) **Date of Patent: *Nov. 10, 2020**

(54) UPPER-BODY GARMENTS WITH INTEGRATED WAISTBAND POSITIONING SYSTEMS

(71) Applicant: Terry Currie Banta, Atlanta, GA (US)

(72) Inventor: Terry Currie Banta, Atlanta, GA (US)

( * ) Notice: Subject to any disclaimer, the term of this patent is extended or adjusted under 35 U.S.C. 154(b) by 1028 days.

This patent is subject to a terminal disclaimer.

(21) Appl. No.: 15/248,345

(22) Filed: Aug. 26, 2016

(65) Prior Publication Data

US 2016/0360811 A1 Dec. 15, 2016

Related U.S. Application Data

(63) Continuation-in-part of application No. 14/628,745, filed on Feb. 23, 2015, now Pat. No. 10,219,565.

(Continued)

(51) Int. Cl.

| | |
|---|---|
| ***A41F 5/00*** | (2006.01) |
| *A41D 31/18* | (2019.01) |
| *A41D 13/00* | (2006.01) |

(52) U.S. Cl.

CPC ..... *A41F 5/00* (2013.01); *A41D 13/0017* (2013.01); *A41D 31/185* (2019.02)

(58) Field of Classification Search

CPC .... A41F 5/00; A41B 1/08; A41B 1/10; A41B 1/18

(Continued)

(56) References Cited

U.S. PATENT DOCUMENTS 263,027 A 8/1882 Crane
443,376 A * 12/1890 Pieter ..... A41F 5/00 2/117

(Continued)

FOREIGN PATENT DOCUMENTS

FR 945558 A 5/1949
GB 423091 A 1/1935

(Continued)

OTHER PUBLICATIONS

PCT/US2015/017068, "International Preliminary Report on Patentability," dated Sep. 9, 2016, 9 pages.

(Continued)

*Primary Examiner* — Khaled Annis
(74) *Attorney, Agent, or Firm* — Kilpatrick Townsend & Stockton LLP

(57) ABSTRACT

Upper-body garment assemblies with integrated waistband positioning systems. In some examples, the waistband positioning system is configured to maintain pants, skirts, leggings, tights, stockings, etc. in proper position against the forces of gravity. In some examples, the waistband positioning system is configured to support another article of clothing and at least partially absorb and/or distribute the forces associated with supporting the other. The garment assembly may be any suitable type of top, shirt, brassiere, camisole, tank top, athletic top, or any other desired article of clothing having a panel with integrated waistband positioning system. In some examples, the waistband positioning system has one or more inner panels or areas configured to move independently from the outer layer of the garment assembly to support the weight of another article of clothing.

20 Claims, 22 Drawing Sheets

Related U.S. Application Data

(60) Provisional application No. 61/943,561, filed on Feb. 24, 2014.

(58) Field of Classification Search
USPC ..... 2/69, 269, 337; 450/28
See application file for complete search history.

(56) References Cited

U.S. PATENT DOCUMENTS 461,434 A * 10/1891 Henry ..... A41D 1/06 2/269
695,629 A 3/1902 James
783,421 A 2/1905 Carr
790,314 A * 5/1905 Robertson ..... A41F 3/00 2/112
823,534 A 6/1906 Hutchinson
900,728 A 10/1908 Harris
1,110,822 A * 9/1914 Reznicek ..... A41F 5/00 2/117
1,522,658 A 1/1925 Voorhees
1,939,327 A 12/1933 Vanace
1,986,508 A 1/1935 Albert
1,986,519 A 1/1935 Murray
2,010,592 A 8/1935 Hollar
2,059,826 A * 11/1936 Tartikoff ..... A41F 5/00 2/107
2,126,591 A * 8/1938 Voss ..... A41C 3/00 450/13
2,133,505 A 10/1938 Green
2,154,684 A * 4/1939 Kool ..... A41F 5/00 2/117
2,181,192 A 11/1939 Moses
2,315,930 A * 4/1943 Burke ..... A41F 11/02 450/27
2,455,852 A 12/1948 Campbell
2,469,793 A * 5/1949 Siegel ..... A41C 1/10 2/300
2,526,785 A 10/1950 Jack
2,698,435 A 1/1955 Robinson
2,752,606 A 7/1956 Phillip
3,167,786 A 2/1965 Johnson
3,411,508 A * 11/1968 Sayers ..... A41C 3/0078 450/27
3,982,547 A * 9/1976 Walker ..... A41C 3/00 450/28
4,671,264 A 6/1987 Frangi
4,773,101 A * 9/1988 Kapp ..... A41B 13/08 2/69.5
4,822,317 A 4/1989 Wimmer
5,036,549 A 8/1991 Jackson
5,172,703 A * 12/1992 Tiede ..... A61F 5/0104 128/869
5,208,920 A * 5/1993 Schaefer ..... A41D 1/06 2/108
5,309,572 A 5/1994 Seamans
5,488,738 A 2/1996 Seamans
5,742,936 A * 4/1998 Tronc ..... A41D 13/012 2/159
5,970,513 A 10/1999 Kocher
6,127,007 A 10/2000 Cox et al.
6,132,412 A 10/2000 Jones
6,308,338 B1 * 10/2001 Caldwell ..... A41D 1/062 2/312
6,446,269 B1 9/2002 Bessler et al.
6,497,683 B1 12/2002 Pagni
6,959,455 B2 11/2005 Hall
7,260,961 B1 8/2007 Kennedy
D562,573 S 2/2008 Herman
7,395,557 B1 7/2008 Ledyard
7,398,558 B1 7/2008 Kattenhorn
7,419,263 B1 9/2008 Pearce et al.
7,441,418 B2 10/2008 Delgado-Mecinas
D581,633 S 12/2008 Seibold
D583,529 S 12/2008 Gardner, III et al.
7,526,929 B2 5/2009 Takamoto et al.
D606,285 S 12/2009 Schindler
D614,946 S 5/2010 Herman
D616,627 S 6/2010 Schindler
D619,495 S 7/2010 Herman
7,752,681 B2 * 7/2010 Michel ..... A41B 9/00 2/409
D622,477 S 8/2010 Schindler
D623,377 S 9/2010 Schindler
7,841,020 B2 * 11/2010 Mayfield ..... A41D 13/1209 2/227
D632,051 S 2/2011 Schindler
D632,052 S 2/2011 Schindler
D632,053 S 2/2011 Schindler
7,997,102 B2 8/2011 Obadalova
8,123,590 B2 2/2012 MacKinnon
D656,298 S 3/2012 Schindler
8,209,779 B2 7/2012 Herman
8,215,773 B2 7/2012 Gibson-Horn et al.
D665,558 S 8/2012 Schindler
8,235,766 B2 * 8/2012 Melarti ..... A41C 1/10 450/155
D666,384 S 9/2012 Schindler
D667,607 S 9/2012 Schindler
8,331,097 B2 12/2012 Yang et al.
8,360,816 B2 1/2013 Michel
8,402,567 B2 * 3/2013 Agassi ..... A41B 9/04 2/400
8,429,773 B2 * 4/2013 Herman ..... A47C 21/022 24/72.5
8,555,421 B2 10/2013 Herman
8,568,195 B1 * 10/2013 Schindler ..... A41C 1/06 450/30
D692,638 S 11/2013 Herman
8,801,494 B2 8/2014 Olumide
8,864,551 B2 10/2014 Melarti et al.
2004/0168286 A1 9/2004 Herman
2004/0221374 A1 11/2004 Baacke
2006/0185056 A1 8/2006 Zwick
2007/0256216 A1 * 11/2007 Kronen ..... A41F 3/02 2/304
2009/0083899 A1 4/2009 Herman
2010/0192285 A1 * 8/2010 Ahn ..... A41B 11/14 2/409
2010/0299802 A1 * 12/2010 Bailey ..... A41B 13/005 2/70
2011/0197335 A1 8/2011 Handy
2012/0060262 A1 * 3/2012 Herman ..... A41F 11/00 2/326
2012/0090078 A1 * 4/2012 von Olnhausen ..... A41C 3/08 2/326
2013/0178133 A1 * 7/2013 Olumide ..... A41C 3/0021 450/11
2013/0247282 A1 * 9/2013 Herman ..... A41F 19/00 2/327
2013/0291277 A1 11/2013 Kirkwood
2015/0230530 A1 8/2015 Choi
2015/0237939 A1 8/2015 Banta

FOREIGN PATENT DOCUMENTS

GB 657059 A 9/1951
WO 2014003390 1/2014
WO 2015127352 A1 8/2015

OTHER PUBLICATIONS

U.S. Appl. No. 14/628,745, "Non-Final Office Action", dated Jan. 29, 2018, 10 pages.
U.S. Appl. No. 14/628,745, Restriction Requirement dated Aug. 2, 2017, 6 pages.
International Patent Application No. PCT/US2015/017068, International Search Report and Written Opinion, dated May 18, 2015, 13 pages.

(56) References Cited

OTHER PUBLICATIONS

"Baby Bump: Suspenders," http://www.popsugar.com/moms/Baby-Bump-Suspenders-1539412, available at least as early as Dec. 20, 2014, 1 page.
"Double Grip Clips," Sock Dreams Customer Reviews, http://www.sockdreams.com, 5 pages, undated.
"Dreamers Recommend Double Grip Clips!," Sock Dreams Blog Post dated Feb. 18, 2011, http://www.sockdreams.com, 5 pages.
"FlowerAndEggs," https://www.etsy.com/listing/175611189/suspenders, Nov. 10, 2014, 4 pages.
"Holdup Hip-clip 2 Wide Trucker Style Suspenders Customer Reviews," http://www.Amazon.com., 3 pages, undated.
"Holdup maternity super soft maternity pant suspenders in various side clip styles . . ." HoldUp Suspender Company, retrieved from the internet at http://www.medicalsuspenders.com/maternity-suspenders.html, available at least as early as Dec. 7, 2014, 5 pages.
"Introducing Specialty Series Holdup Suspenders™," HoldUp Suspender Company, 9 pages, undated.
"Invisible Suspenders™ the unique, comfortable and functional way to hold up your pants . . . under your clothing," Niva, 1 page, undated.
"Patented Hidden Suspenders in Trucker Side Clip Style-Metal Clips," http://www.Amazon.com, 6 pages, undated.
"New! The Hip-Clip® Suspenders," 1 page, undated.
Niva Designer Pregnancy Collection, http://www.nivacollection.com/invisible_Suspenders.htm, available at least as early as Dec. 20, 2014, 4 pages.
"Sale Garter Strap Suspender Tank Top Pant Jumpsuit Catsuit 16 my Bodysuit S M L," Ebay website, available at least as early as May 15, 2013, 7 pages.
Sales Catalog 930, HoldUp Suspender Company, 35 pages, available at least as early as Feb. 23, 2014.
"Sispenders," https://www.etsy.com/listing/203662938/suspenders, Sep. 16, 2014, 3 pages.
"Suspender Clip Industrial Garter Belt," Sock Dreams Customer Reviews, http://www.sockdreams.com, 8 pages, undated.
"Tuggs Maternity Suspenders — White," http://www.Amazon.com, available at least as early as Dec. 20, 2014, 3 pages.
"The Up T-shirt," UpCouture Paris, http://upcouture.com/en/content/4-the-up-t-shirt, available at least as early as Mar. 2, 2014, 4 pages.
"Welch Trucker Suspenders *Tall Avail* Customer Reviews," http://www.Amazon.com, 4 pages, undated.
U.S. Appl. No. 14/628,745, Notice of Allowance dated Jan. 14, 2019, 13 pages.

* cited by examiner

UPPER-BODY GARMENTS WITH INTEGRATED WAISTBAND POSITIONING SYSTEMS

CROSS REFERENCE TO RELATED APPLICATIONS

This application is a continuation-in-part of U.S. application Ser. No. 14/628,745, filed on Feb. 23, 2015, and entitled "Upper-Body Garments with Integrated Waistband Positioning Systems," which is related to and claims priority benefits from U.S. Provisional Application Ser. No. 61/943,561, filed on Feb. 24, 2014, and entitled "Undergarments with Integrated Suspender Systems," both of which are hereby incorporated by reference in their entireties by this reference.

FIELD OF THE INVENTION

This application relates to garments and, more particularly, garments with integrated waistband positioning systems.

BACKGROUND

Suspenders have long been used to help hold up pants, skirts, shorts, stockings, or other garments against the forces of gravity and/or a person's body shape. Suspenders are sometimes used when a belt is not feasible (for example, because of the design of the attaching garment (i.e., no belt loops)) or because a belt would create bulk, undesirable aesthetic effects, or cinching discomfort for the wearer. Suspenders are traditionally comprised of straps which are worn over the shoulders. The straps are usually configured in an "x" or "y" pattern and terminate with fastening mechanisms that attach to and connect lower body garments to the suspender straps. The forces of gravity and weight of the lower garment being supported are borne primarily by the suspender-wearer's shoulders. Suspenders can be bulky, cumbersome, uncomfortable, and result in an undesired aesthetic for the wearer.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Examples of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

This patent discloses garments with waistband positioning systems. In some examples, the garment or article of clothing is configured to support another article of clothing and absorb and/or distribute at least some of the forces associated with gravity acting on the other article of clothing. In some examples, the waistband positioning system is integrated with a panel configured to absorb and/or distribute at least some of the forces associated with gravity. In some examples, the panel extends at least partially across the sides of the garment and across the back of the garment to help absorb and/or distribute the forces of gravity.

In some examples, a garment assembly may have one or more inner panels that is configured to move independently from the outer layer of the garment assembly. These inner panels may absorb and distribute forces associated with supporting another article of clothing throughout the garment assembly.

In some examples, the integrated waistband positioning systems may be adjustable. For example, the system may be designed so the amount of tension placed on the waistband positioning system is adjustable. In some examples, the garment assembly may have two or more distal ends or force distribution areas. In certain examples, the waistband positioning system may have one distal end or force distribution area on each side. In other examples, the waistband positioning system may have two distal ends or force distribution areas on each side for a total of four distal ends or force distribution areas. In other examples, the waistband positioning system may have a third, centrally located distal end or force distribution area disposed at the rear that works in conjunction with two or four side distal ends or force distribution areas.

In some examples, the garment assembly includes an inner panel that is arranged to define a channel between the inner panel and the article of clothing. The channel may have an opening defined by an end of the inner panel that moves freely and independently from the article of clothing. In various examples, the waistband positioning system is positioned within the channel such that a force distribution area of the waistband positioning system moves freely and independently relative to the article of clothing. In some examples, a portion of the waistband positioning system extends through the channel opening.

BRIEF DESCRIPTION OF THE DRAWINGS

Illustrative examples of the present invention are described in detail below with reference to the following drawing figures.

DETAILED DESCRIPTION

Figure 1:
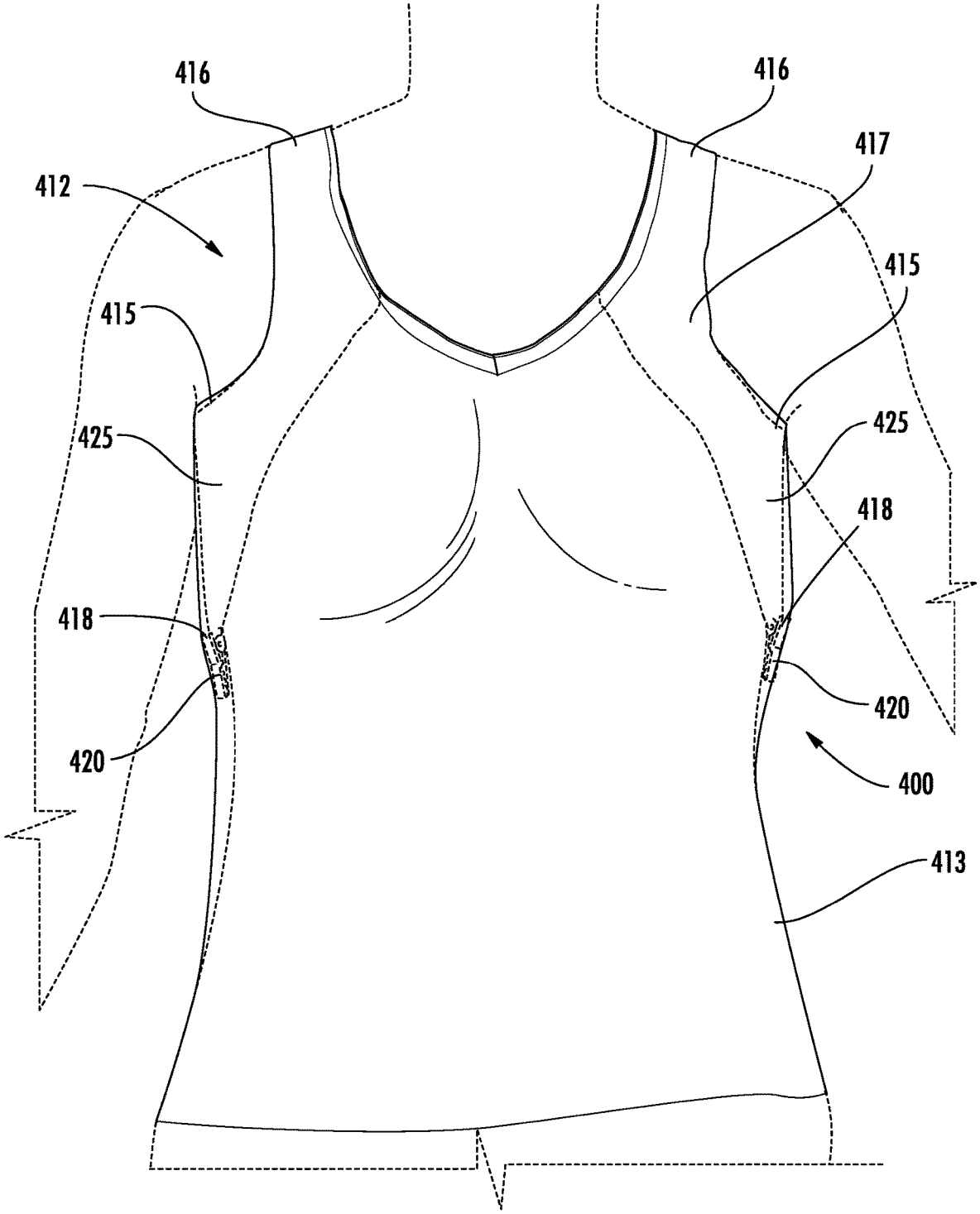
FIG. 1 is a front view of a garment assembly with integrated waistband positioning system according to an example of the current disclosure.

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

This patent discloses various upper-body garment assemblies configured to provide a user with a comfortable, concealed mechanism to secure pants, shorts, skirts, leggings, tights, stockings or other articles of clothing in the proper position. The disclosed garment assemblies include waistband positioning systems that are configured to help hold up or otherwise maintain in proper position at least one article of clothing such as, but not limited to, pants, shorts, skirts, leggings, tights, and stockings. In some examples, the garment assembly includes a panel incorporated with the waistband positioning system and configured to at least partially absorb and/or distribute the forces associated with gravity attempting to pull down the article of clothing with which the waistband positioning system cooperates. In some examples, the panel extends across the back and optionally across at least a portion of the sides of the garment assembly. In some examples, the garment assembly includes one or more inner panels that are configured to move independently from the outer layer of the garment assembly. These inner panels are configured to absorb and distribute forces of gravity associated with supporting another article of clothing. The panel configuration of the garment assembly distributes weight and forces associated with supporting a garment at least partially across the back and other portions of the garment assembly so as to reduce weight and strain on the shoulders.

In some examples, the garment assembly includes an inner panel that is arranged to define a channel between the inner panel and the article of clothing. The channel may have an opening defined by an end of the inner panel that moves freely and independently from the article of clothing. In various examples, the waistband positioning system is positioned within the channel such that a force distribution area of the waistband positioning system moves freely and independently relative to the article of clothing. In some examples, a portion of the waistband positioning system extends through the channel opening.

FIGS. 1-5 illustrate a non-limiting example of a garment assembly 400 with an integrated waistband positioning system 412. Waistband positioning system 412 serves as an inner layer 417 that is concealed by an outer layer 413 of the garment assembly 400. In some examples, the inner layer 417 is woven in a seamless fashion.

The outer layer 413 may be part of a shirt, tank top, camisole, or any other article of clothing intended to be worn on the upper body. The outer layer 413 provides the aesthetic features of the garment assembly 400 and conceals the waistband positioning system 412. In some examples, portions of garment assembly 400 are made of a material that has body shaping and/or slimming properties.

Figure 2:
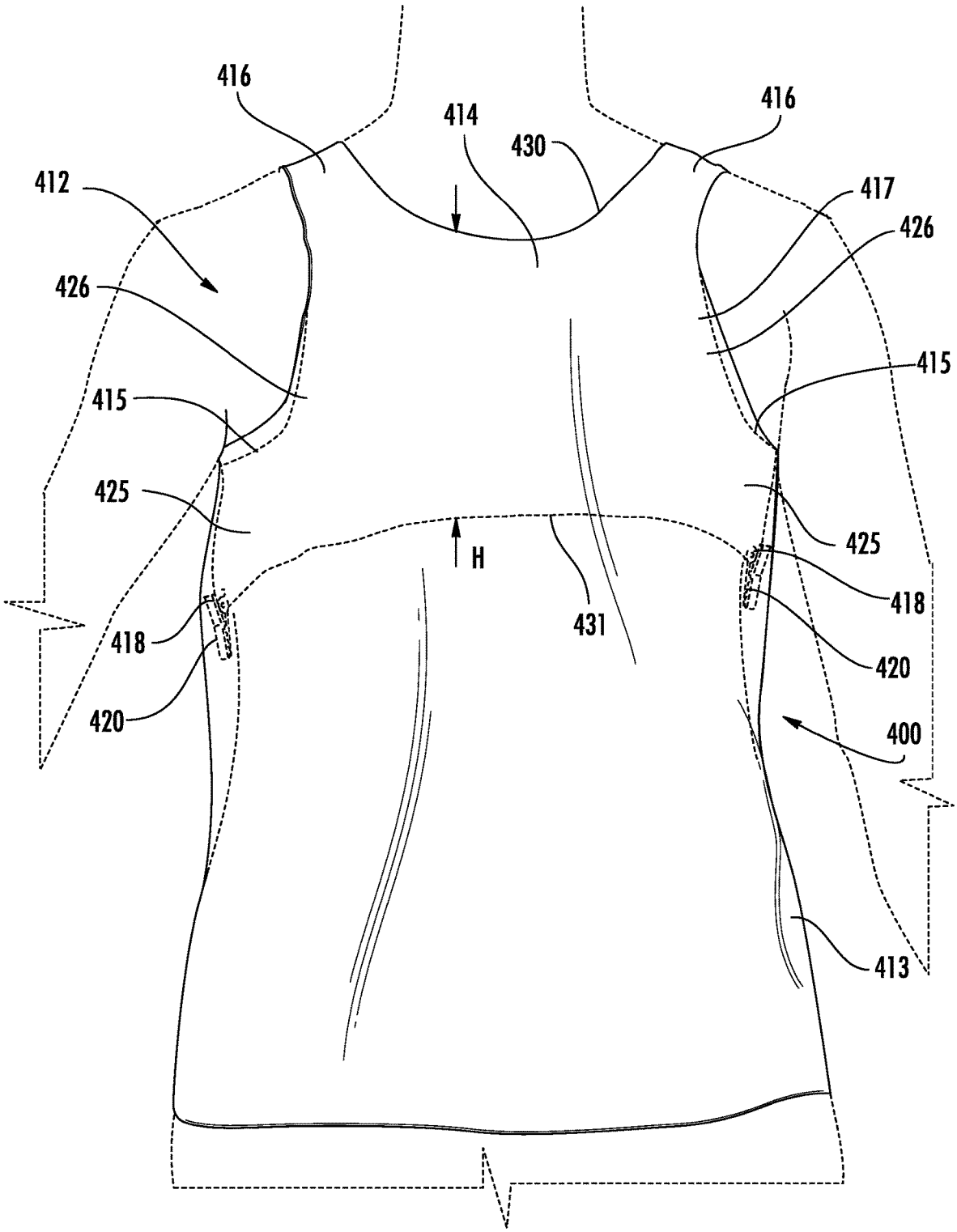
FIG. 2 is a rear view of the garment assembly of FIG. 1.

As shown in FIG. 2, waistband positioning system 412 includes a panel 414. Panel 414 is illustrated as generally rectangular, but could also be generally oval, circular, square, or any other shape. Panel 414 may be integral with or separable from the waistband positioning system 412. In some examples, the panel 414 is made of a four-way stretch material or fabric (i.e., material or fabric that stretches and recovers both crosswise and lengthwise) or any other suitable stretch material that absorbs or distributes in at least two dimensions the forces of gravity attempting to pull down the article with which the waistband positioning system 412 is engaged. The waistband positioning system 412 and/or the panel 414 may be made from a single piece of material, or assembled from more than one piece of material.

Figure 3:
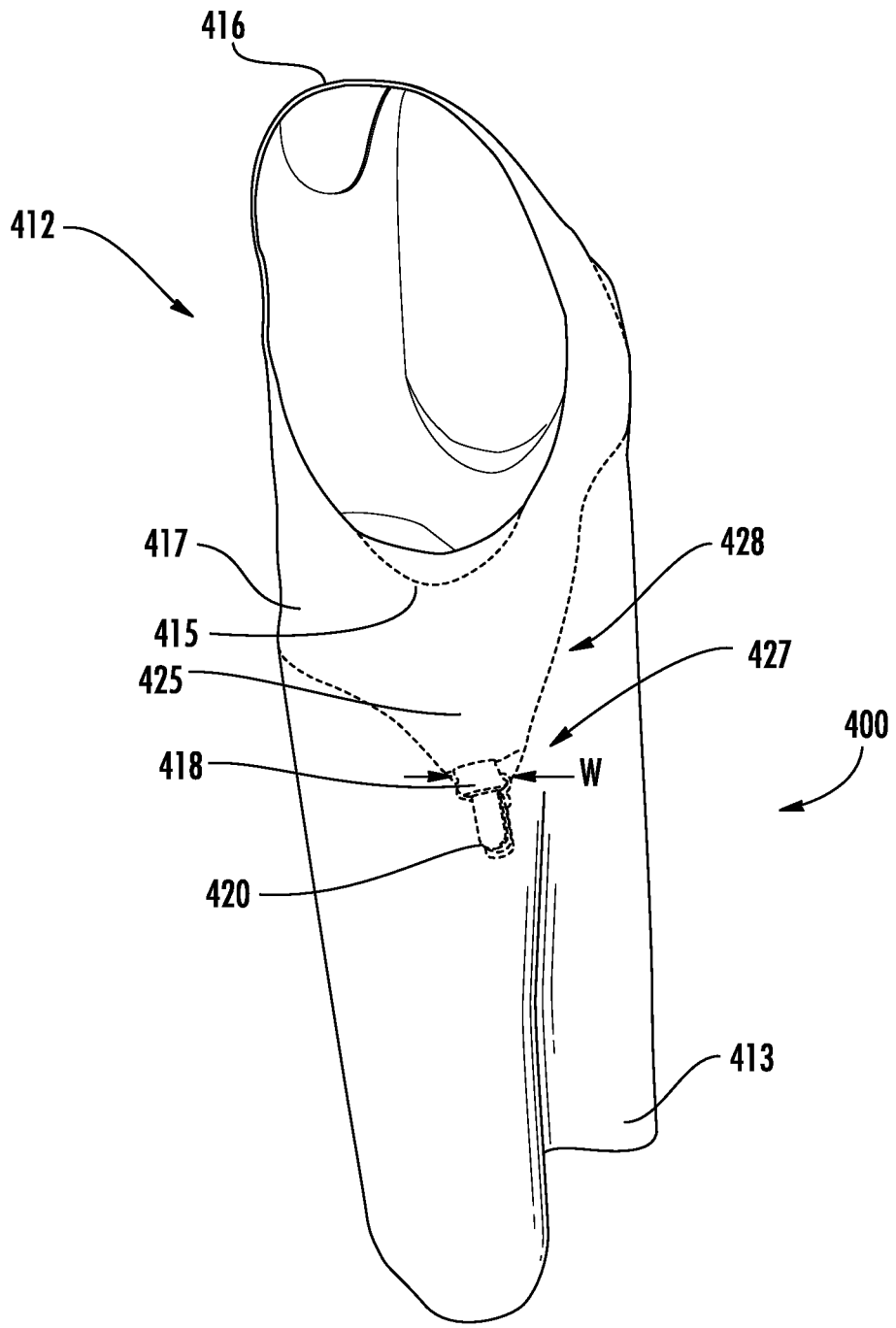
FIG. 3 is a side view of the garment assembly of FIG. 1, shown in isolation.

As shown in FIGS. 2-3, panel 414 includes sides 426 and extends across the rear and at least partially across the sides of the garment assembly 400. Panel 414 may extend from a bottom edge 431 vertically to a top edge 430, and at least partially across the back of the garment assembly 400 between sides 426. In some examples, the bottom edge 431 and the top edge 430 may extend between sides of the garment assembly 400. The waistband positioning system 412 also includes two shoulder portions 416 that extend from the panel 414 at or near its top edge 430. The shoulder portions 416 may be integral with or separable from the panel 414, and may extend from the rear of the garment assembly toward the front of the garment assembly 400 along side portions of the garment assembly 400. In certain examples, the shoulder portions 416 may connect or attach to other portions of the waistband positioning system 412. As explained below, the shoulder portions 416 of the waistband positioning system 412 are coupled with corresponding shoulder portions of the outer layer 413 of the garment assembly 400.

Figure 5:
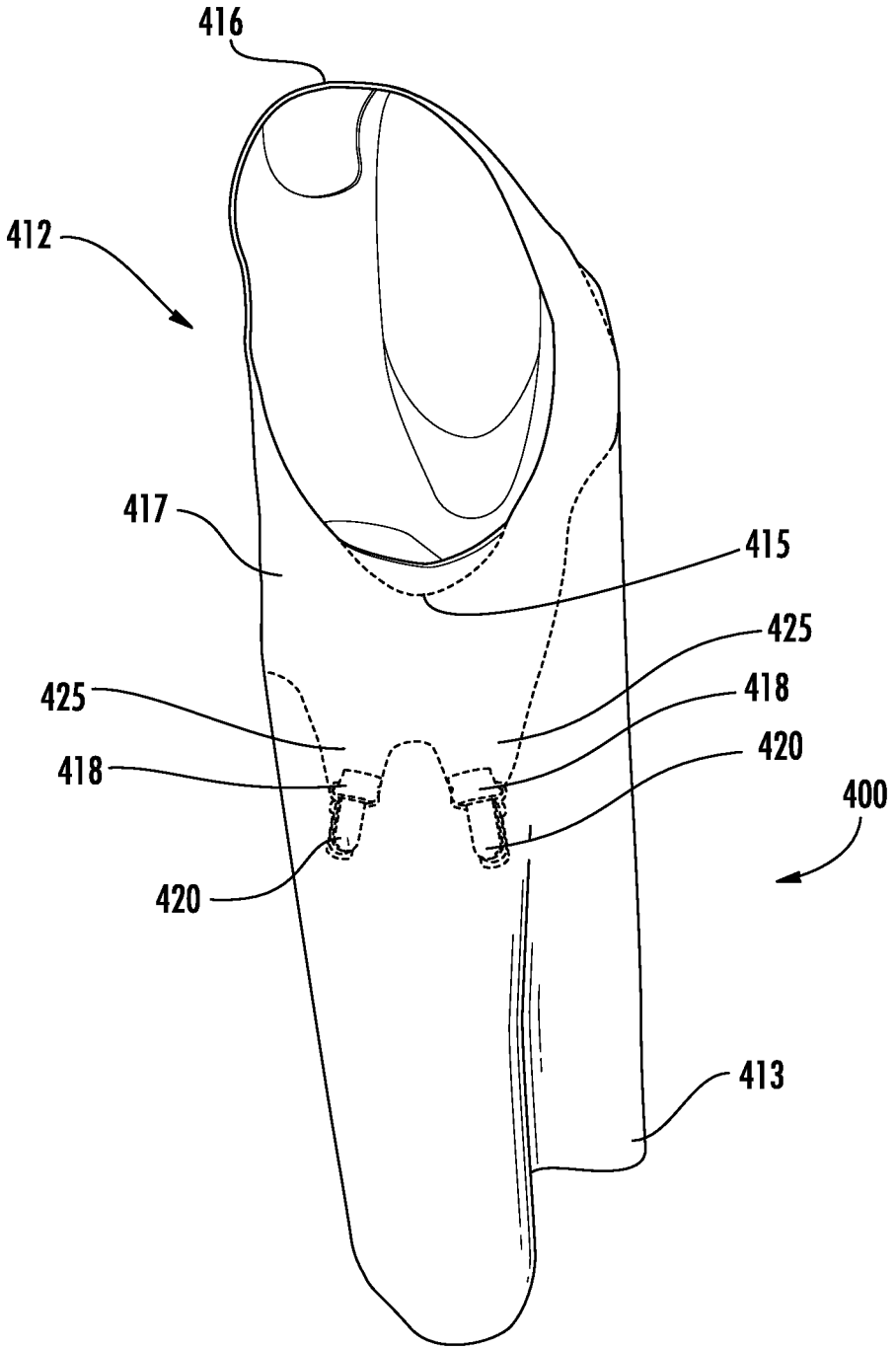
FIG. 5 is a side view of an alternative example of the garment assembly of FIG. 1, shown in isolation.

In some examples, as shown in FIGS. 3 and 5, the waistband positioning system 412 includes force distribution areas 425 that extend from the sides 426 of the panel 414. These force distribution areas 425 may have any suitable configuration, including the generally triangular configuration shown in FIGS. 3 and 5, and may be unattached from the outer layer 413 throughout the area. Force distribution areas 425 are configured to absorb forces applied to the waistband positioning system 412 from the article with which it is engaged and distribute them across an area of the panel 414 and/or shoulder portions 416. Other shapes of the force distribution areas 425 are possible, including rectangular, circular, oval, etc. The waistband positioning system 412 may have two, four, or any suitable number of force distribution areas 425. The example shown in FIGS. 1-4 includes two force distribution areas 425, with one area extending from each side 426 of panel 414. The example shown in FIG. 5 includes four force distribution areas 425, with two areas extending from each side 426 of panel 414.

Distal ends 418 of the force distribution areas 425 may extend downwardly from the waistband positioning system 412 along a side of the garment assembly 400. Each distal end 418 is configured to cooperate with an article such as pants, a skirt, stockings, leggings, etc. More particularly, the distal ends 418 may include one or more suitable fasteners such as, but not limited to, clip 420 that cooperates with the article to counteract the forces of gravity. Instead of clip 420, snaps, buttons, magnets, hook and loop structures, or any other suitable fastener may be used.

To vary the effective vertical length of such distal ends 418 relative to the article of clothing with which the garment assembly 400 will be used, the clip or other suitable fastener 420 of distal ends 418 may be positioned at different locations around the article of clothing with which they interact. More specifically, the effective vertical length of the distal ends 418 may be altered by moving the clips or fasteners 420 further or closer to the natural hanging location of the distal ends 418. This method of adjustment allows for adjustment of the effective vertical length of the distal ends 418 (and consequent height of the waistband of the article with which the invention interacts) without the additional bulk or cost of an adjuster mechanism.

Alternatively, if desired, distal ends 418 of the waistband positioning system 412 may include one or more adjusters (not illustrated) capable of adjusting the length and/or tension of the distal ends 418 to suit the needs of the user. The adjuster may be a buckle, slide, or other suitable mechanism.

Figure 4:
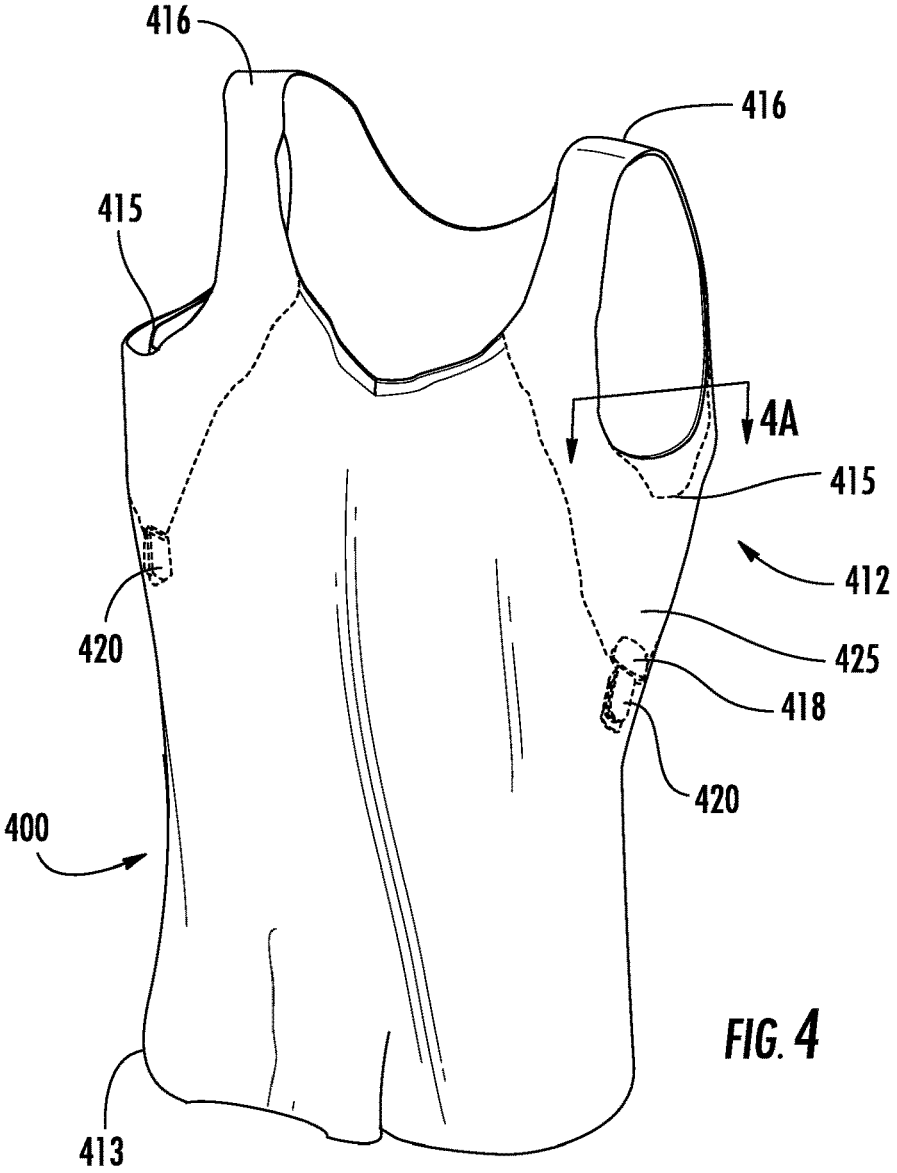
FIG. 4 is a front perspective view of the garment assembly of FIG. 1, shown in isolation.
Figure 4A:
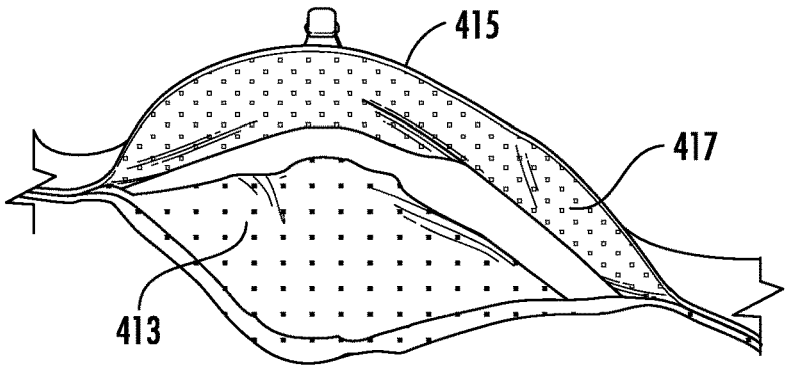
FIG. 4A is a detailed top view of a portion of the garment assembly of FIG. 4, taken at the line 4A of FIG. 4.

Each of the force distribution areas 425 includes an independent edge 415 disposed opposite the distal end 418 of the force distribution area 425 to allow the force distribution area 425 to move freely and independently from the outer layer 413 and any portions of the inner layer 417 that are secured to the outer layer 413 (see FIGS. 3 and 4A). Specifically, independent edge 415 is not secured with or otherwise attached to outer layer 413. When the waistband positioning system 412 is engaged with an article of clothing that it is supporting, the independent edge 415 allows the force distribution area 425, which are not attached to the outer layer 413, to flex and stretch independently of the outer layer 413. As a result, the force distribution areas 425 help distribute forces due to supporting an article of clothing throughout the panel 414 and waistband positioning system 412 without distortion, bunching, or otherwise changing the aesthetics of the outer layer 413. By way of example and for illustrative purposes only, the independent edge 415 of the waistband positioning system 412 may deflect or stretch downwards to accommodate the load that is transferred through the force distribution areas 425 and to the panel 414. Because the independent edge 415 is free from the outer layer 413, it allows the waistband positioning system 412 to deflect independently of the outer layer 413, which will remain at or near its normal position.

The waistband positioning system 412 may be integrated into the garment assembly 400 and its outer layer 413 in any number of ways including, but not limited to, weaving, stitching, adhering, or through the use of any number of fasteners such as clips, buttons, snaps, or hook and loop structures. The waistband positioning system 412 may also be seamlessly integrated into the garment assembly 400 as a single piece of material.

In some examples, the waistband positioning system 412 is secured with the outer layer 413 of the garment assembly 400 at or along the shoulder portions 416. More specifically, the waistband positioning system 412 may be woven with, connected or attached to the outer layer 413 at discrete points along the shoulder portions 416 or continuously or partially continuously along the shoulder portions 416, which are configured to extend over the shoulder of the wearer. However, the attachment of the waistband positioning system 412 should not interfere with the independent edge 415, which allows the waistband positioning system 412 to deflect and distribute forces through the force distribution areas 425 without disturbing the outer layer 413 of the garment assembly 400.

In some cases, the waistband positioning system 412 also may be secured to the outer layer 413 by weaving, stitching, adhesive, or other suitable means at one of the top edge 430 or bottom edge 431 of the panel 414, or at both of top edge 430 or bottom edge 431. In some examples, the other of the top edge 430 or bottom edge 431 of the panel 414 remains free to move independently of the outer layer 413 to allow the panel 414 to flex and distribute forces from the force distribution areas 425 across an area without disturbing the outer layer 413 of the garment assembly 400. In some examples, both the top edge 430 and bottom edge 431 of the panel 414 remain free to move independently of the outer layer 413 to allow the panel 414 to flex and distribute forces from the force distribution areas 425 without disturbing the outer layer 413 of the garment assembly 400.

Figure 6:
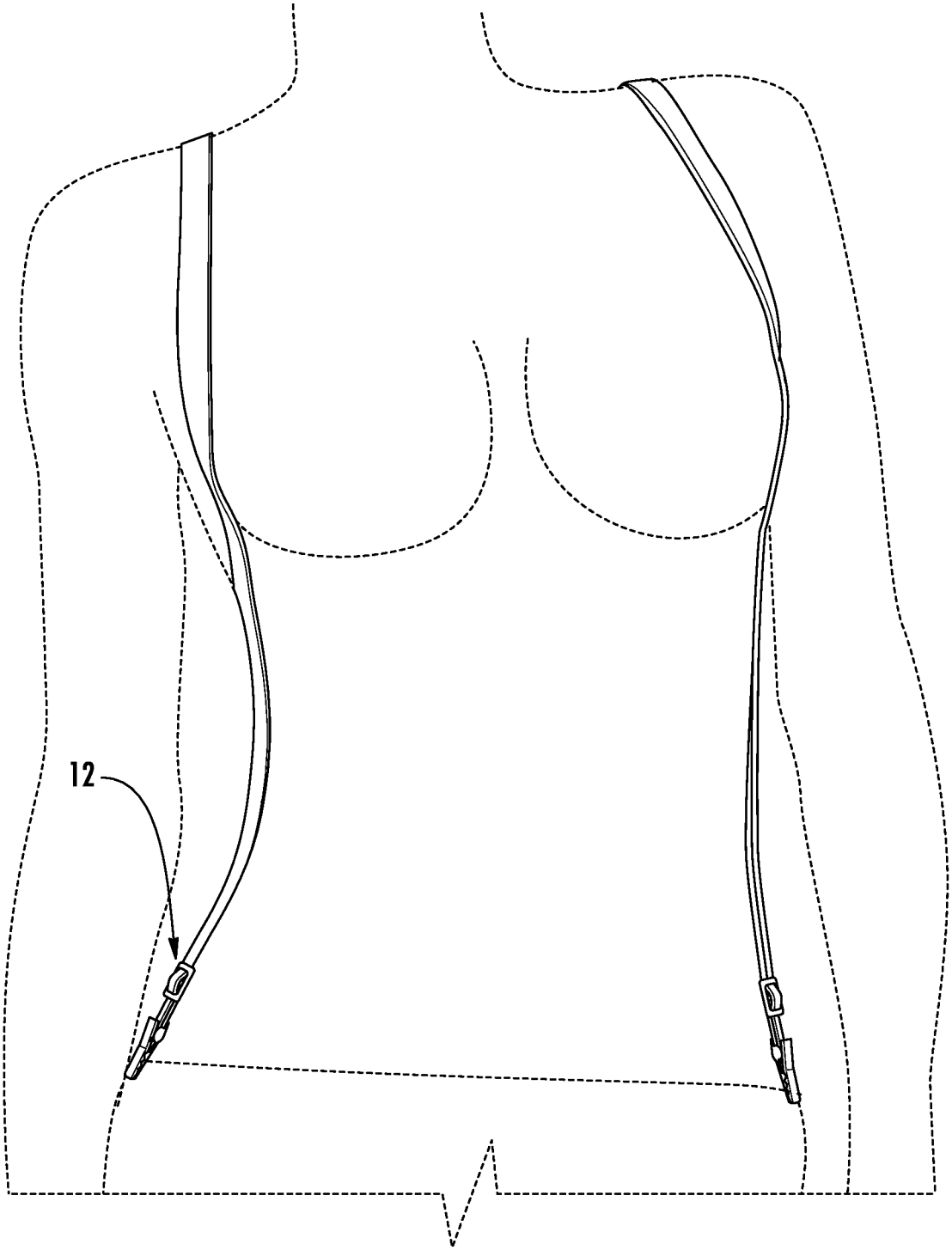
FIG. 6 is a front view of a waistband positioning system according to an example of the current disclosure.
Figure 7:
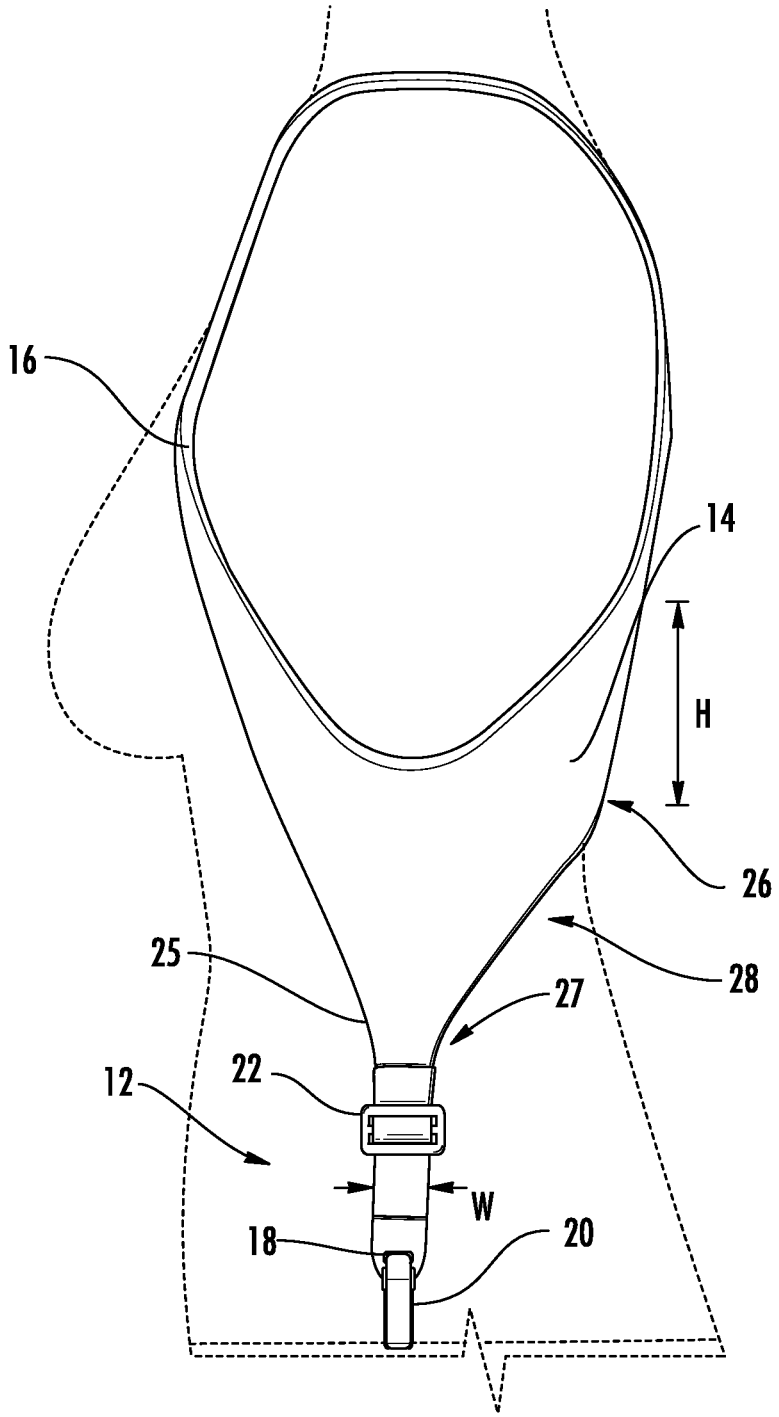
FIG. 7 is a side view of the waistband positioning system of FIG. 6.
Figure 8:
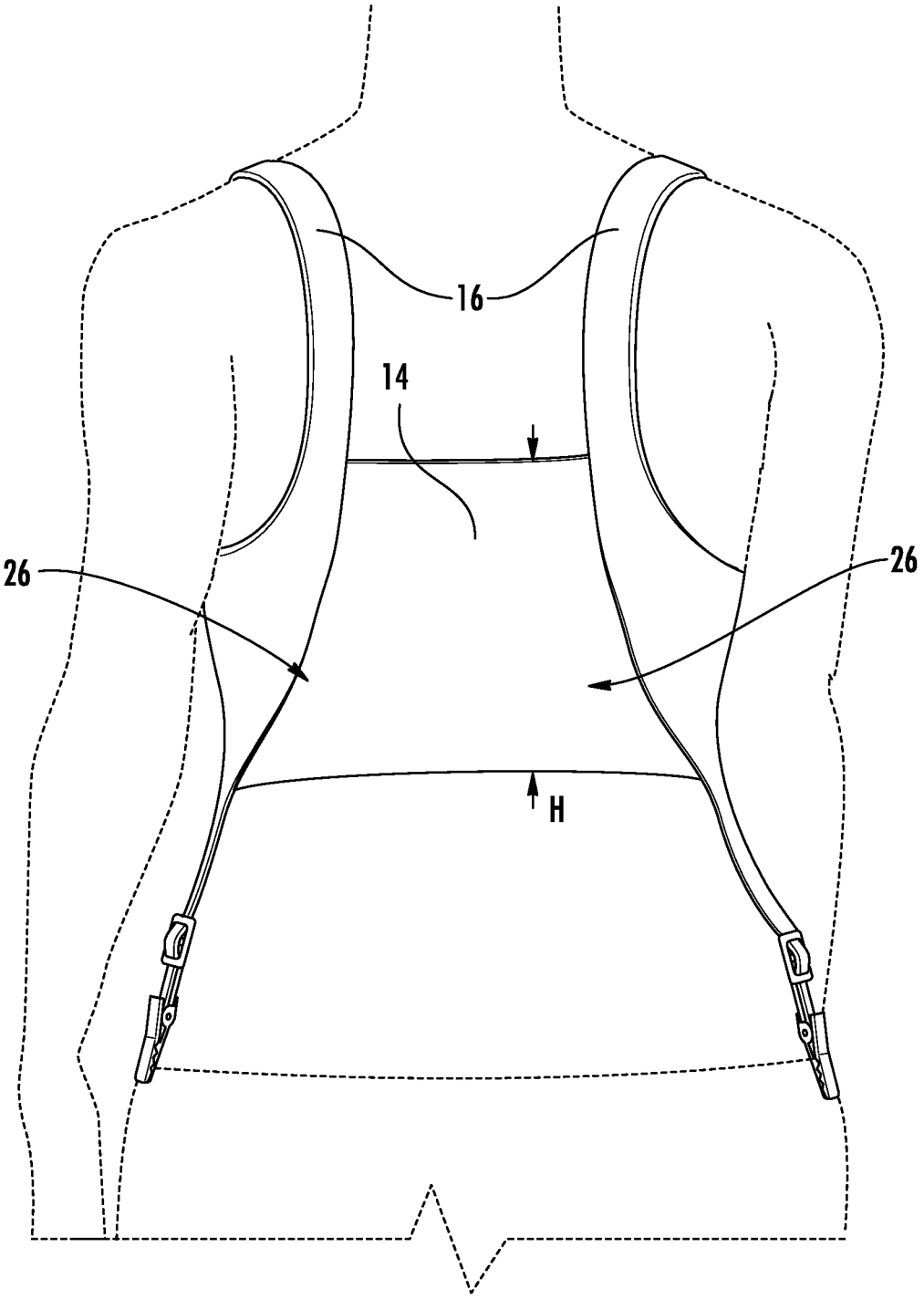
FIG. 8 is a rear view of the waistband positioning system of FIG. 6.

FIGS. 6-8 illustrate a non-limiting example of a standalone waistband positioning system 12. As shown in FIGS. 6-8, the waistband positioning system 12 includes a panel 14. Panel 14 may be either integral with or separable from the remainder of the waistband positioning system 12. In some examples, panel 14 is made of four-way stretch material or fabric (i.e., material or fabric that stretches and recovers both crosswise and lengthwise) or any other suitable stretch material that absorbs or distributes in at least two dimensions the forces of gravity attempting to pull down the article with which the waistband positioning system 12 is engaged. Some non-limiting examples of four-way stretch material include spandex, elastane, and microfiber. In some examples, portions of waistband positioning system 12 are made of a material that has body shaping and/or slimming properties.

In the example of FIGS. 6-8, panel 14 extends across the rear of the waistband positioning system 12 and at least partially across the sides of waistband positioning system 12, although panel 14 may extend across the rear and/or sides of the system, or any combination thereof. Panel 14 is illustrated as generally rectangular, but may also be generally oval, circular, square, or any other shape. In some examples, as shown in FIG. 7, force distribution areas 25 extend from side portions 26 of the panel 14. These force distribution areas 25 may have any suitable configuration, such as a generally triangular configuration as illustrated to absorb forces applied to the waistband positioning system 12 from the article with which it is engaged. Other shapes of the force distribution areas 25 are possible, including rectangular, circular, oval, etc. Like waistband positioning system 412, the waistband positioning system 12 may have two, four, or any number of force distribution areas 25.

As shown in FIG. 7, distal ends 18 extend downwardly from the waistband positioning system 12. The waistband positioning system 12 includes two or more distal ends 18, which may be an integral part of or fixedly attached to the force distribution areas 25 or may be detachable with respect to the force distribution areas 25. Each distal end 18 is configured to cooperate with an article such as pants, a skirt, stockings, leggings, etc. More particularly, distal end 18 may include one or more suitable fasteners such as, but not limited to, clip 20 that cooperates with the article to counteract the forces of gravity. Instead of clip 20, snaps, buttons, magnets, hook and loop structures, or any other suitable fastener may be used.

Although the waistband positioning system 12 is illustrated as only having two force distribution areas 25, the waistband positioning system 12 may include any suitable number of force distribution areas and accompanying fasteners. For example, one or more additional force distribution areas 25 may extend from any suitable portion of the panel 14 if more support is desired. As one example, a third force distribution area 25 (with accompanying distal end and fastener) may be positioned to extend from the panel 14 such that it extends down the user's back when the waistband positioning system 12 is worn. In this example, the additional force distribution area extends from the rear of panel 14. As another example, the waistband positioning system 12 may include four force distribution areas 25 (with accompanying distal ends and fasteners). These force distribution areas 25 may be disposed in pairs at both side portions 26 of the waistband positioning system 12, or at any suitable location.

As shown in FIG. 7, the waistband positioning system 12 may optionally include one or more adjusters 22 capable of adjusting the length and/or tension of the distal ends 18 to suit the needs of the user. The adjuster 22 may be a buckle, slide, or other suitable mechanism. Distal ends 18 may also be adjusted for length and/or tension without the use of the adjuster 22.

In other examples, adjusters 22 are not used. To vary the effective vertical length of such distal ends 18 relative to the article of clothing with which the waistband positioning system 12 will be used, the clip or other suitable fastener 20 of distal ends 18 may be positioned at different locations around the article of clothing with which they interact. More specifically, the effective vertical length of the distal ends 18 may be altered by moving the clips or fasteners 20 further or closer to the natural hanging location of the distal ends 18. This method of adjustment, which may be used with any example of the invention, allows for adjustment of the effective vertical length of the distal ends 18 (and consequent height of the waistband of the article with which the invention interacts) without the additional bulk or cost of an adjuster mechanism.

The waistband positioning system 12 of FIGS. 6-8 also includes two shoulder portions 16. As shown in FIG. 7, each shoulder portion 16 extends from panel 14 toward a front of the waistband positioning system 12. As illustrated, each of the shoulder portions 16 is configured to extend over a user's shoulder. The shoulder portions 16 may be formed of elasticized fabric or any other suitable material and may have different configurations as desired or required by the particular style and function of the waistband positioning system 12 (racer back, etc.).

Figure 9:
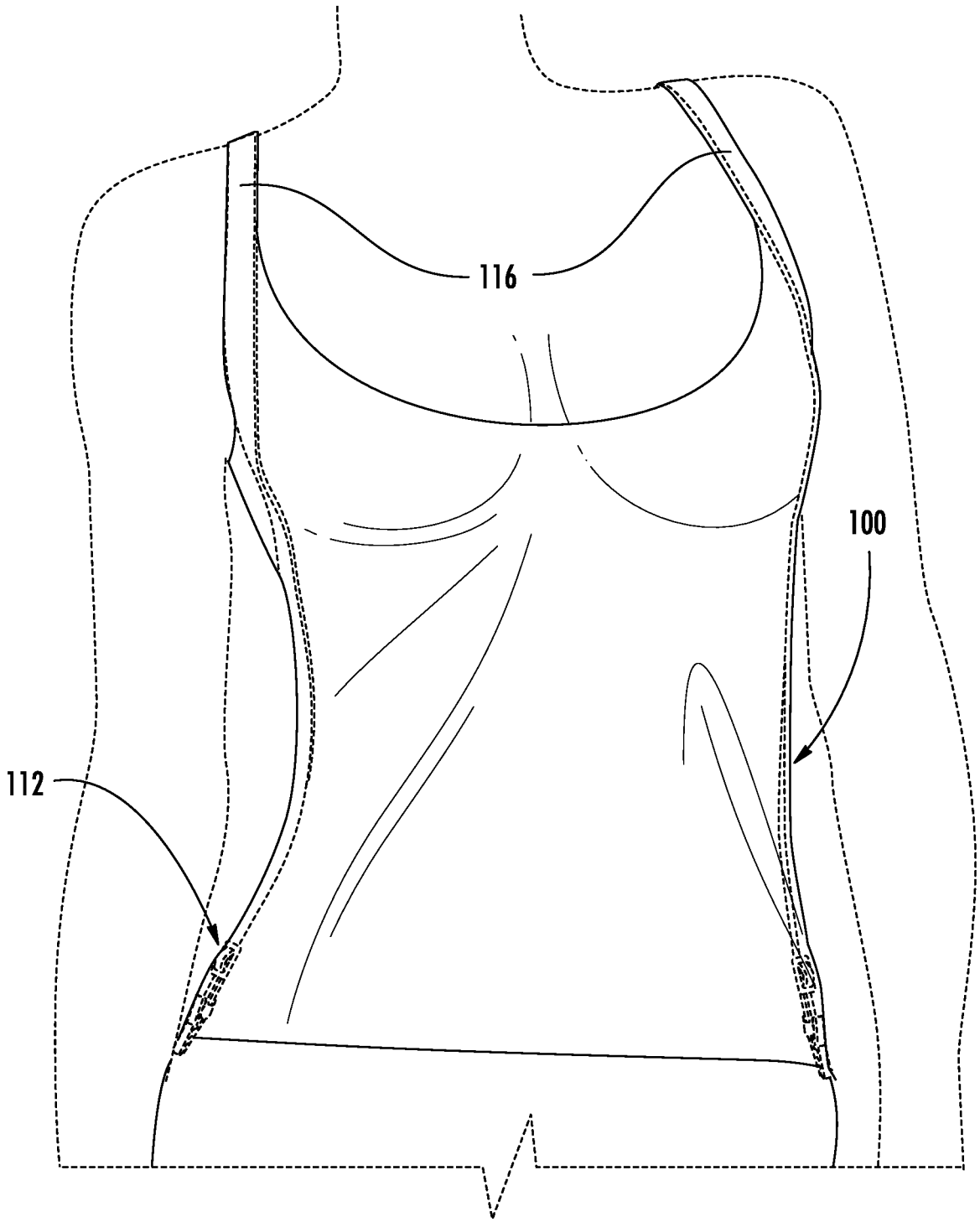
FIG. 9 is a front view of a garment assembly with integrated waistband positioning system according to an example of the current disclosure.
Figure 10:
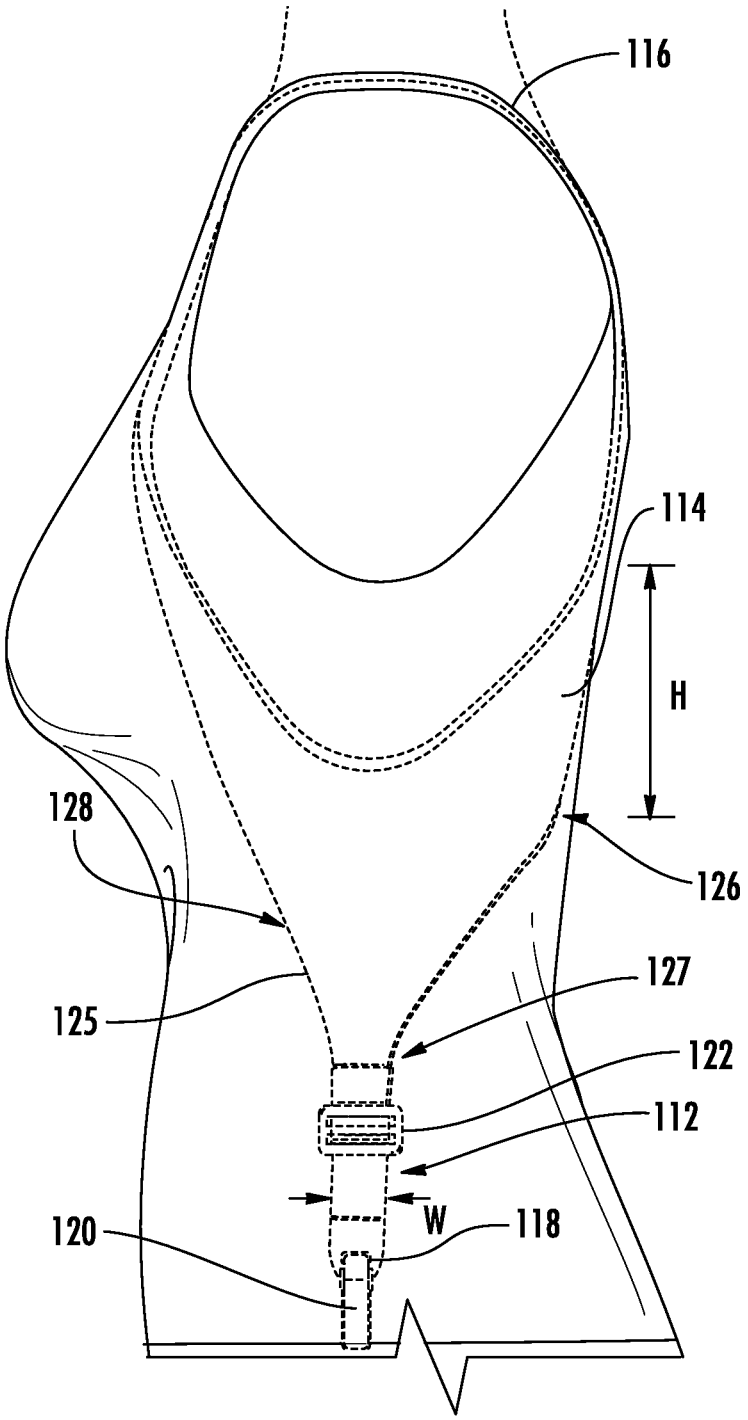
FIG. 10 is a side view of the garment assembly of FIG. 9.
Figure 11:
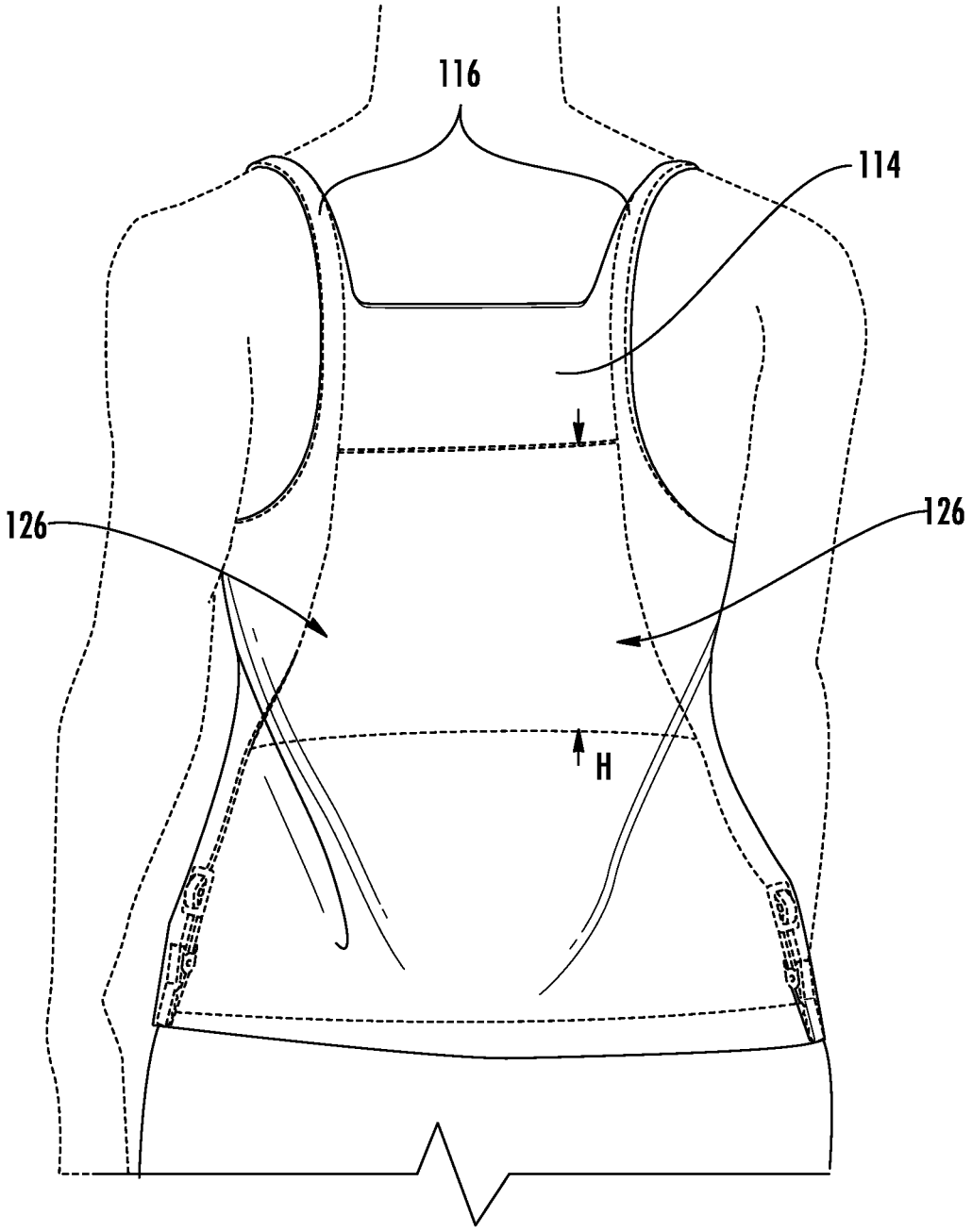
FIG. 11 is a rear view of the garment assembly of FIG. 9.
Figure 12:
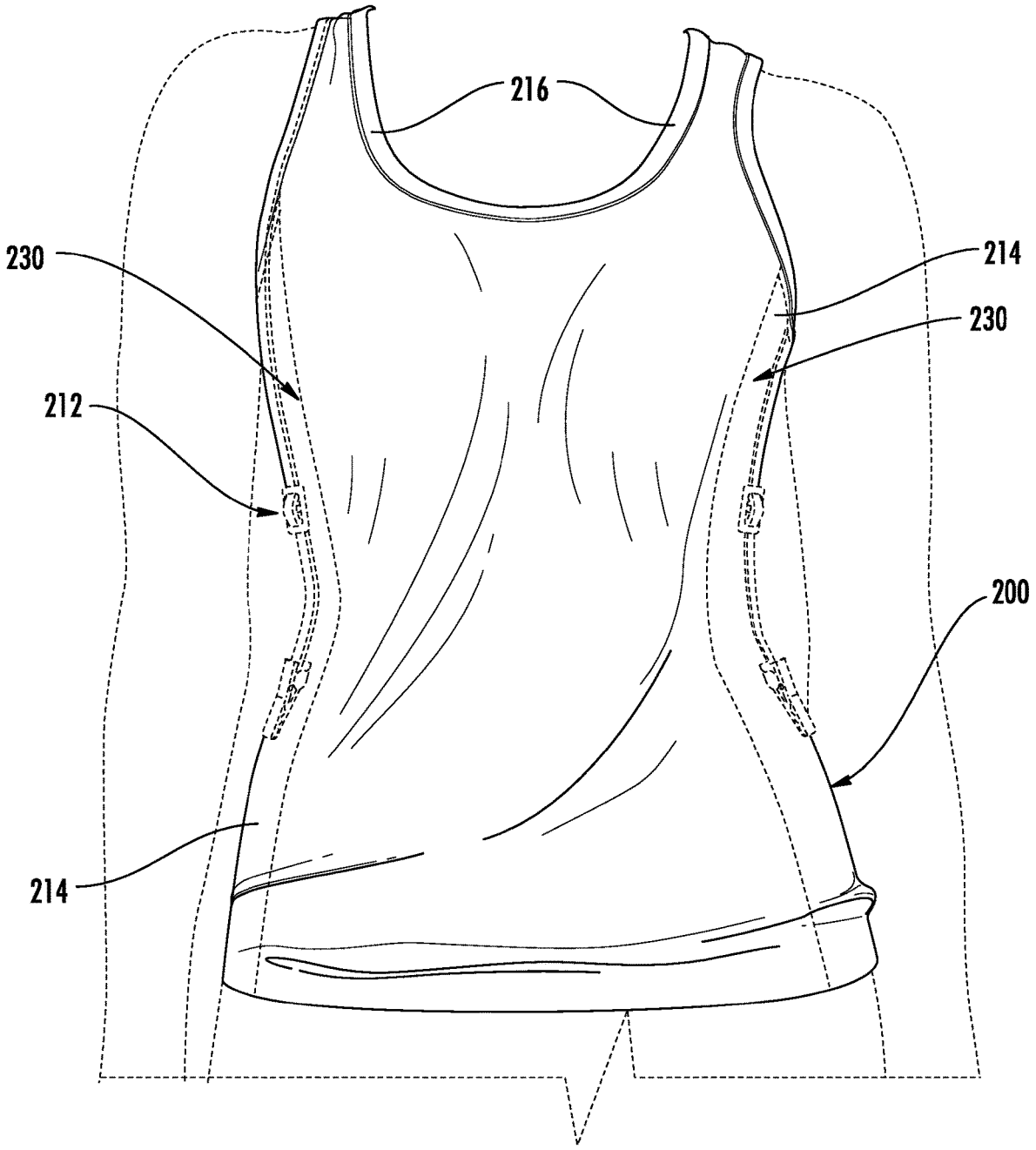
FIG. 12 is a front view of a garment assembly with integrated waistband positioning system according to an example of the current disclosure.
Figure 13:
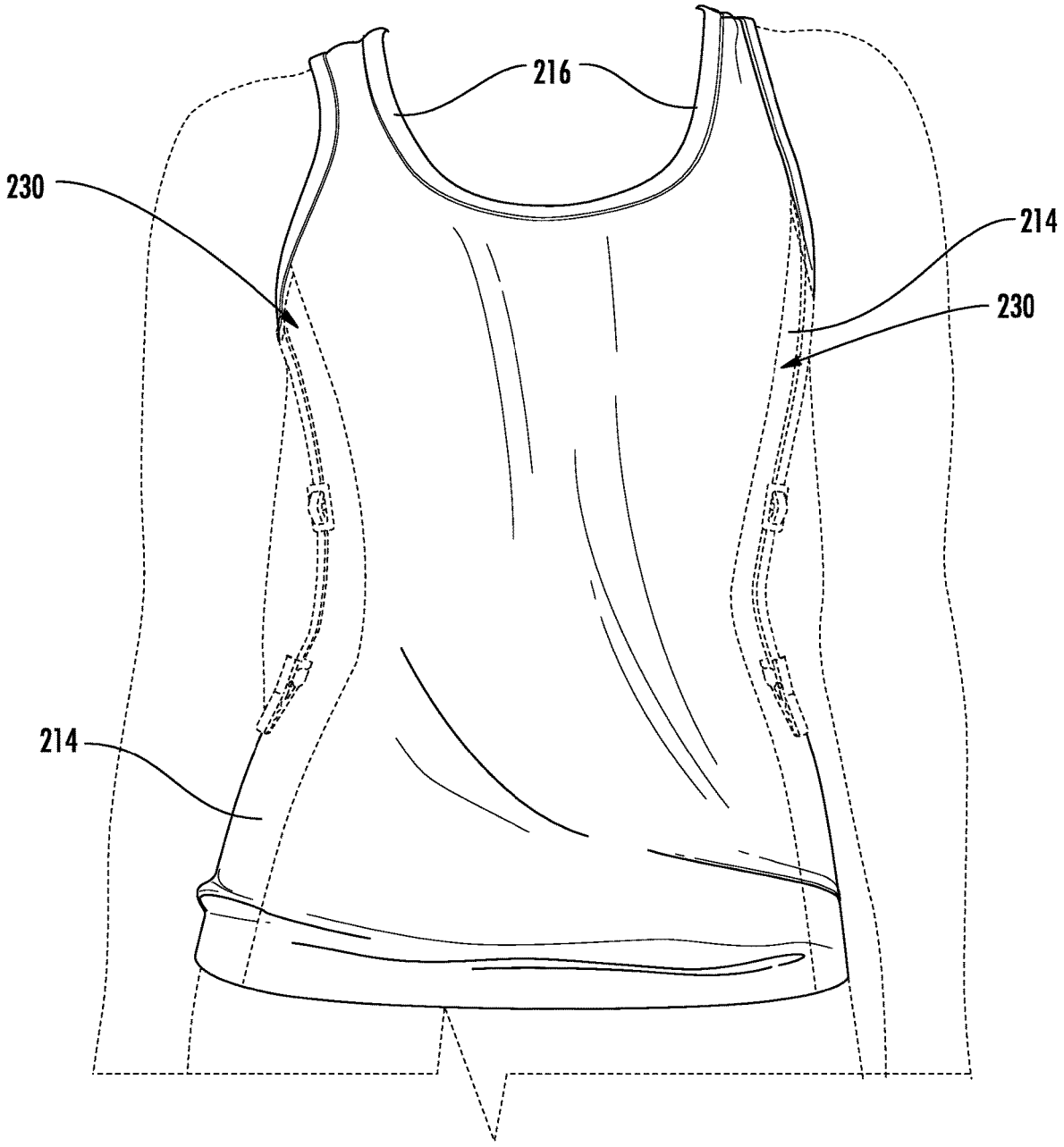
FIG. 13 is a rear view of the garment assembly of FIG. 12.

FIGS. 9-11 illustrate a garment assembly 100 having an integrated waistband positioning system 112 that includes a panel 114, which may be constructed of a four-way stretch material (i.e., material or fabric that stretches and recovers both crosswise and lengthwise). As shown in FIGS. 9-11, the waistband positioning system 112 is incorporated into the construction of a camisole, tank top, shirt, bra, or other article of clothing to be worn on the upper body to form the garment assembly 100. More specifically, the waistband positioning system 112 is incorporated into the camisole, tank top, or other article of clothing such that the fabric of the camisole or tank top covers the waistband positioning system 112 when the camisole or tank top is worn by a user.

Panel 114 is illustrated as generally rectangular, but may be generally oval, circular, square, or any other shape, and is designed and configured to absorb and distribute in at least two dimensions forces associated with gravity attempting to pull down the article with which the waistband positioning system 112 is used. In this way, the panel 114 is designed to help structurally support the waistband positioning system 112. Panel 114 may extend across the rear or sides of the garment assembly 100, or any combination thereof. In some cases, at least a portion of the panel 114 (the sides 126 of the panel 114 as illustrated) interacts with force distribution areas 125, which may have a triangular configuration to help absorb and distribute these forces. Like waistband positioning system 12, waistband positioning system 112 may include any number of force distribution areas 125, and they may have any suitable configuration as described above.

Like waistband positioning system 12, waistband positioning system 112 includes two or more distal ends 118. The waistband positioning system 112 may be integrated or combined with a shirt, camisole, tank top, or other article of clothing in any number of ways. In some examples, the waistband positioning system 112 is incorporated in a way that allows the distal ends 118, force distribution areas 125, and/or the panel 114 to move independently from the material of the shirt, tank top, camisole, or other article of clothing. As one example, force distribution areas 125 may have an independent edge that is not connected with the tank top, camisole, shirt, or other article of clothing. By allowing the panel 114, distal ends 118 and/or force distribution areas 125 to move independently of the material of the shirt, tank top, camisole, or other article, the panel 114, distal ends 118, and/or force distribution areas 125 are better able to distribute and absorb forces from the article of clothing they support. Furthermore, independent movement of the panel 114, distal ends 118, and/or force distribution areas 125 prevents unsightly bunching or stretching of the outer layer of material of the camisole, tank top, or other article of clothing, and is more comfortable for the wearer.

The waistband positioning system 112 and panel 114 may be incorporated into the shirt, camisole, tank top, bra, or other article when the camisole or tank top or other article is manufactured, or the waistband positioning system 112 and panel 114 may be retrofit to an already-manufactured shirt, camisole, tank top, or other article. When the waistband positioning system 112 and panel 114 are incorporated into another article of clothing, such as a shirt, bra, camisole, or tank top, the waistband positioning system 112 and panel 114 may integrate with any existing shoulder portions 116 or structures of the standard article or garment assembly 100. The waistband positioning system 112 or panel 114 may also have shoulder portions independent of the standard article. These shoulder portions may be offset from the shoulder portions 116 of the standard article or may be hidden beneath them to create a double shoulder portion configuration. If the camisole, tank top or other article includes an integrated shelf bra, the waistband positioning system 112 and/or panel 114 may be integrated into the shelf bra such that the shelf bra or portions of the shelf bra serve as an additional panel segment or as the panel that absorbs and distributes at least some of the forces of gravity attempting to pull down the article with which the waistband positioning system 112 is engaged. In some cases, an existing shelf bra may serve as the panel 114.

As with the example of FIGS. 6-8, the distal ends 118 may each include a fastener 120 such as a clip. As illustrated, at least some of the distal ends 118 extend from a side of the waistband positioning system 112. In some examples, a third distal end 118 may be positioned to extend from the rear of panel 114 such that the third distal end 118 would extend down the user's back when the garment assembly 100 is worn. In other examples, two distal ends 118 extend from each side of the waistband positioning system 112, for a total of four distal ends. As with the example of FIGS. 6-8, distal ends 118 may be detachable or may be permanently fixed to the force distribution areas 125.

In certain examples, the waistband positioning system 112 is seamless with or otherwise constructed so that it is inseparable from the panel 114 and/or the rest of the garment assembly 100. In other examples, the waistband positioning system 112 is sewn or otherwise affixed to the panel 114 and/or the rest of the garment assembly 100.

In the examples of FIGS. 1-5 and 9-11 the garment assembly 100, 400 may be any suitable top, shirt, brassiere, camisole, tank top, athletic top such as a sports bra, or any other desired article. In the example of FIGS. 6-8, waistband positioning system 12 is a standalone article intended solely for the purpose of supporting another article of clothing. The garment assembly 100, 400 or waistband positioning system 12 may have any suitable configuration, such as demi-style, vest-style, cropped, etc. In some examples, one or more body shaping features may be incorporated into the garment assembly 100, 400 or waistband positioning system 12. For example, the degree, amount of elasticity, and size of the panel 14, 114, 414 may be selected so that it has body shaping features. In certain examples, the panel 14, 114, 414 may be made of a single piece of material, or it may be assembled from smaller, independent pieces of material that are joined together to form the panel 14, 114, 414. The panel 14, 114, 414 may also be joined with portions of the waistband positioning system 12, 112, 412 through any suitable connection means, including weaving, stitching, sewing, bonding, or fasteners such as snaps, clips, buttons, or hook and loop structures. In some examples, the panel 14, 114, 414 and waistband positioning system 12, 112, 412 may be fashioned from a single, seamless piece of material. In the examples of FIGS. 1-11, and other associated or related examples which may not be shown, the panel 14, 114, 414 is disposed between the force distribution areas 25, 125, 425 and the shoulder portions 16, 116, 416. Such an arrangement allows the panel 14, 114, 414 to absorb the forces from the force distribution areas 25, 125, 425 and distribute them in at least two dimensions across the panel 14, 114, 414 before the forces are transferred at least partially to the shoulder portions 16, 116, 416. In some examples, the forces are distributed substantially along an entire length of the panel 14, 114, 414.

The panel 14, 114, 414 of FIGS. 1-11 may be sized and shaped to prevent digging in, gouging, or otherwise impinging on the wearer. The garment assembly 100, 400 and/or waistband positioning system 12, 112, 412 may be configured to distribute the forces from the force distribution areas 25, 125, 425 over an area comprising at least a majority of a width of the panel 14, 114, 414 to distribute the forces across a wearer's back. In some examples, the height H of the panel 14, 114, 414 is at least twice the width W of the distal ends 18, 118, 418. As shown in the illustrated examples, generally triangular force distribution areas 25, 125, 425 extend from each side 26, 126, 426 of the rear of the panel 14, 114, 414 and are configured to absorb the load from the waistband positioning system 12, 112, 412. Specifically, the generally triangular force distribution areas 25, 125, 425 include a narrower portion 27, 127, 427 and a wider portion 28, 128, 428 with the narrower portion 27, 127, 427 accepting the load from distal ends 18, 118, 418 and distributing the forces associated with the load in at least two dimensions up to the wider portion 28, 128, 428 and through the rear portion of the panel 14, 114, 414. The configuration of the generally triangular sections helps distribute the load from the waistband positioning system 12, 112, 412 over a larger area into the panel 14, 114, 414 for additional comfort and stability. As illustrated, in some cases, the wider portion 28, 128, 428 of the generally triangular force distribution areas 25, 125, 425 is at least twice as wide as the narrower portion 27, 127, 427 of the generally triangular force distribution areas 25, 125, 425. In some cases, the wider portion 28, 128, 428 of generally triangular force distribution areas 25, 125, 425 may be at least two to four times as wide as the narrower portion 27, 127, 427 of the generally triangular force distribution areas 25, 125, 425.

FIGS. 12-15 illustrate a non-limiting example of a garment assembly 200 having a waistband positioning system 212 and inner panels 214 disposed within an outer layer 213 of the garment assembly 200. The outer layer 213 covers and conceals the waistband positioning system 212. The inner panels 214 and outer layer 213 may be integral with, fashioned from the same piece of material, or may be separable from the front and back pieces of the article of clothing. The inner panels 214 are secured to an outer layer 213.

Figure 14:
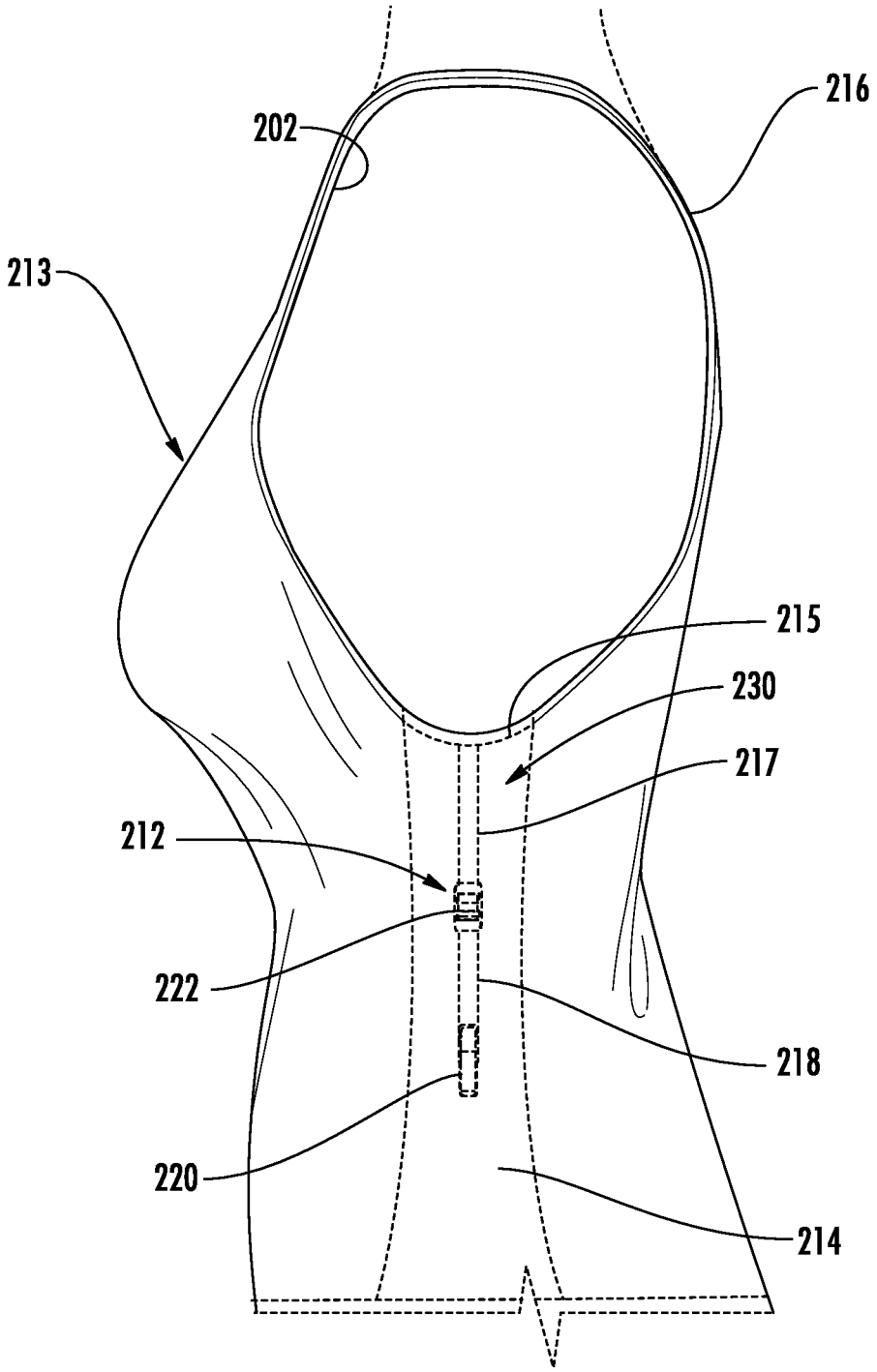
FIG. 14 is a side view of the garment assembly of FIG. 12.
Figure 15:
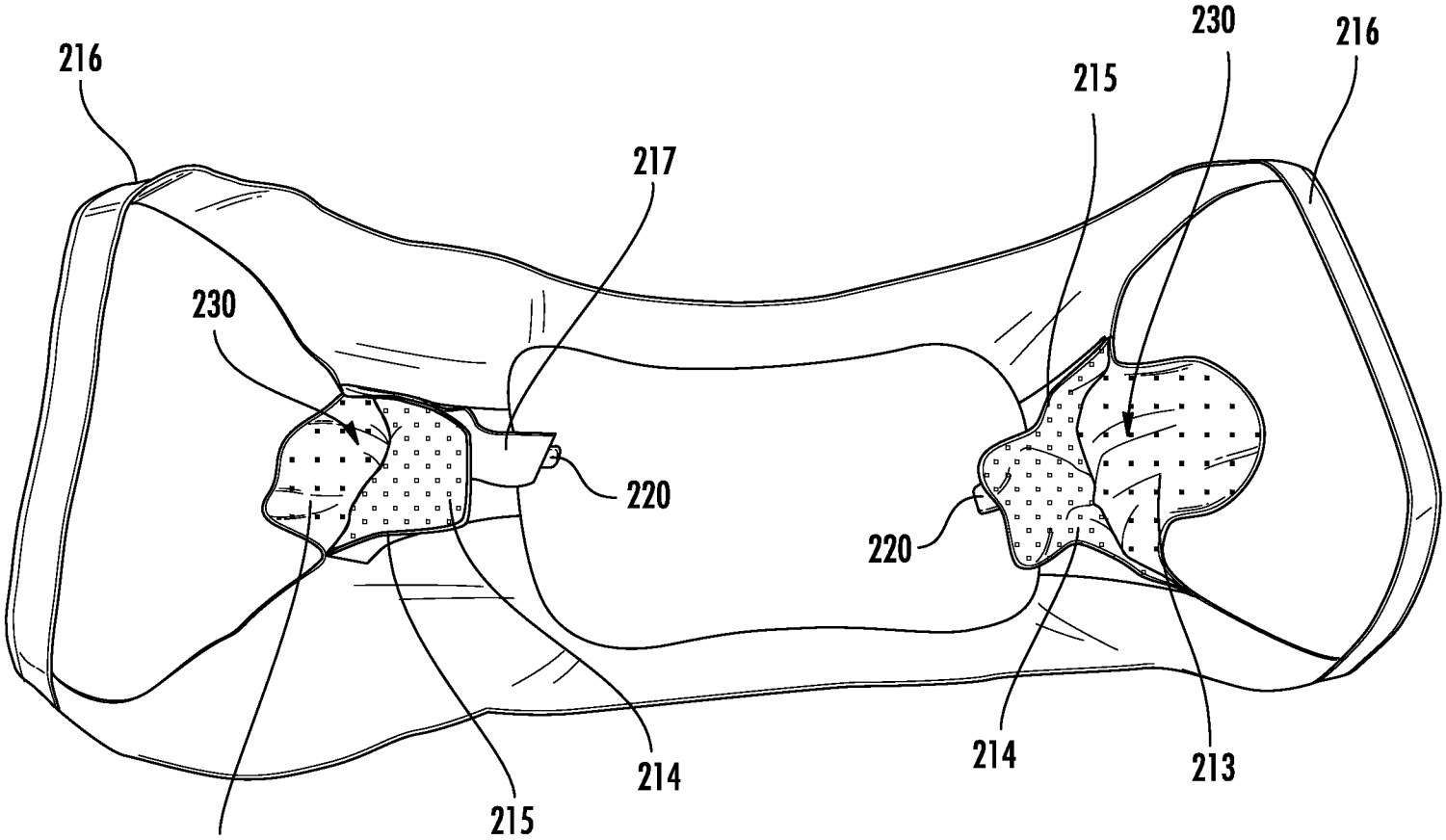
FIG. 15 is a top view of the garment assembly of FIG. 12.

As illustrated in FIG. 14, each of inner panels 214 includes an independent edge 215 that allows the inner panel 214 to move freely and independently from the outer layer 213, as explained in more detail below. As shown in FIGS. 12-15, the waistband positioning system 212 is connected to inner panels 214 at any suitable location. In some examples, the inner panels 214 are an elasticized or four-way stretch material or fabric (i.e., material or fabric that stretches and recovers both crosswise and lengthwise), or any other suitable stretch material that absorbs and/or distributes at least some of the forces of gravity attempting to pull down the article with which the waistband positioning system 212 interacts.

As shown in FIGS. 12-15, inner panels 214 may be disposed along the sides of the garment assembly 200 and run generally from an arm hole 202 of the garment assembly 200 towards the bottom of the garment assembly 200. Inner panels 214 may be attached or secured to the garment assembly 200 at any location, and may be disposed in any direction as desired or required by the particular aesthetics or function of any individual article of clothing. In some examples, the inner panels 214 may be seamlessly integrated with the outer layer 213. For example, inner panels 214 may be integrated with outer layer 213 by overlaying material on top of the outer layer 213 such that a portion of the outer layer 213 is overlaid so that a portion of the outer layer 213 becomes the inner panel 214 and the overlaid material becomes part of the outer layer 213. In other examples, the outer layer 213 may be composed of multiple portions of fabric that are joined together to form the outer layer 213. In some examples, material may be under-laid with respect to the outer layer 213 to become the inner panel 214. The inner panels 214 may be attached either at discrete points or continuously or partially continuously around their perimeter to the outer layer 213 so long as the inner panels 214 feature an independent edge 215 that is independent from the outer layer 213. In some examples, the inner panels 214 and outer layer 213 may be composed of smaller portions of fabric and may be integral or separable with respect to each other and the inner panels 214 or outer layer 213.

As shown in FIGS. 12-15, the combination of the inner panel 214 and outer layer 213 provides a seam or seams where the inner panel 214 is secured to the outer layer 213 with an opening at the independent edge 215. In some examples, the inner panel 214 is secured to outer layer 213 so as to form a covered channel 230 in conjunction with outer layer 213 (see FIGS. 14-15). The independent edge 215 may be located at or near the arm hole 202 of the garment assembly 200, although the location and configuration of the independent edge 215 may be adjusted to suit the particular design and function of the garment assembly 200. For example, the covered channel could be positioned along the front, back, or sides of the garment assembly 200, or any combination thereof.

The waistband positioning system 212 of FIGS. 12-15 includes two or more waistband positioning straps 217 with distal ends 218 configured to cooperate with an article such as pants, a skirt, stockings, etc. The distal ends 218 may include one or more suitable fasteners such as, but not limited to, clip 220 that cooperates with the article to be supported to counteract the forces of gravity. Instead of the clip 220, snaps, buttons, magnets, hook and loop structures, or any other suitable fastener may be used. The waistband positioning straps 217 may also include adjusters 222 capable of adjusting the length and or tension of the waistband positioning straps 217 to suit the needs of the user. The adjuster 222 may be a slide, buckle, or other suitable mechanism. As shown in FIGS. 12-15, the waistband positioning straps 217 are secured to the inner panels 214 at or near the independent edge 215. The waistband positioning straps 217 may be secured to the inner panels 214 so that they are adjacent to the inside of the garment assembly 200, or so they are between the inner panels 214 and outer layer 213. In certain examples, the garment assembly may have additional waistband positioning straps 217. For example, each inner panel 214 may include two waistband positioning straps 217 for a total of four waistband positioning straps. Likewise, a single waistband positioning strap 217 may have a forked end to provide two clips 220 per waistband positioning strap 217. Furthermore, any number of waistband positioning straps 217 and clips 220 may be used in conjunction with garment assembly 200 as desired or required.

When the waistband positioning straps 217 are engaged with another article of clothing, the forces of gravity attempting to pull down the article will be transferred to the inner panels 214, which may then deflect, stretch, or otherwise move independent of the outer layer 213 because of the configuration of the independent edges 215. The independent movement of the inner panels 214 allows the forces to be distributed over an area and transferred to the outer layer 213 without bunching or distorting the outer layer 213 or causing discomfort to the user. The forces may then be transferred to the shoulder portions 216 and/or other portions of the garment assembly 200 without any unsightly changes to the outer layer 213. By way of example and for illustration purposes only, during use, the independent edge 215 of the inner panel 214 may deflect or stretch downwards to accommodate the load that is transferred through the waistband positioning straps 217. The independent edge 215 may then move downwards with respect to the arm hole 202 without (or with minimal) distortion to the outer layer 213. The movement of the independent edge 215 will not be visible to an observer, and the garment assembly 200 will maintain its aesthetic appearance.

In certain examples, the garment assembly 200 of FIGS. 12-15 may be a shirt (sleeved, sleeveless, or strapless), a tank top, camisole, or any other article of clothing worn on the upper body. The garment assembly 200 may include multiple inner panels 214 configured vertically, horizontally, or at any angle in between. The independent edge 215 of the inner panel 214 may be oriented at any location that distributes the loads from the waistband positioning straps 217. One or more additional inner panels may be included in the garment assembly 200 without the waistband positioning strap 217. These additional inner panels may be used to help distribute and absorb forces that are transferred to the inner panels 214 that are connected to waistband positioning straps 217. Additional inner panels may then help further distribute forces throughout the garment assembly 200 to reduce or prevent stretching or distortion of the outer layer 213. In some examples, the waistband positioning straps 217 may be detachable from the inner panels 214. This allows the user to wear the garment assembly 200 as a conventional article of clothing without the use of the waistband positioning system 212 when it is not required.

Figure 16:
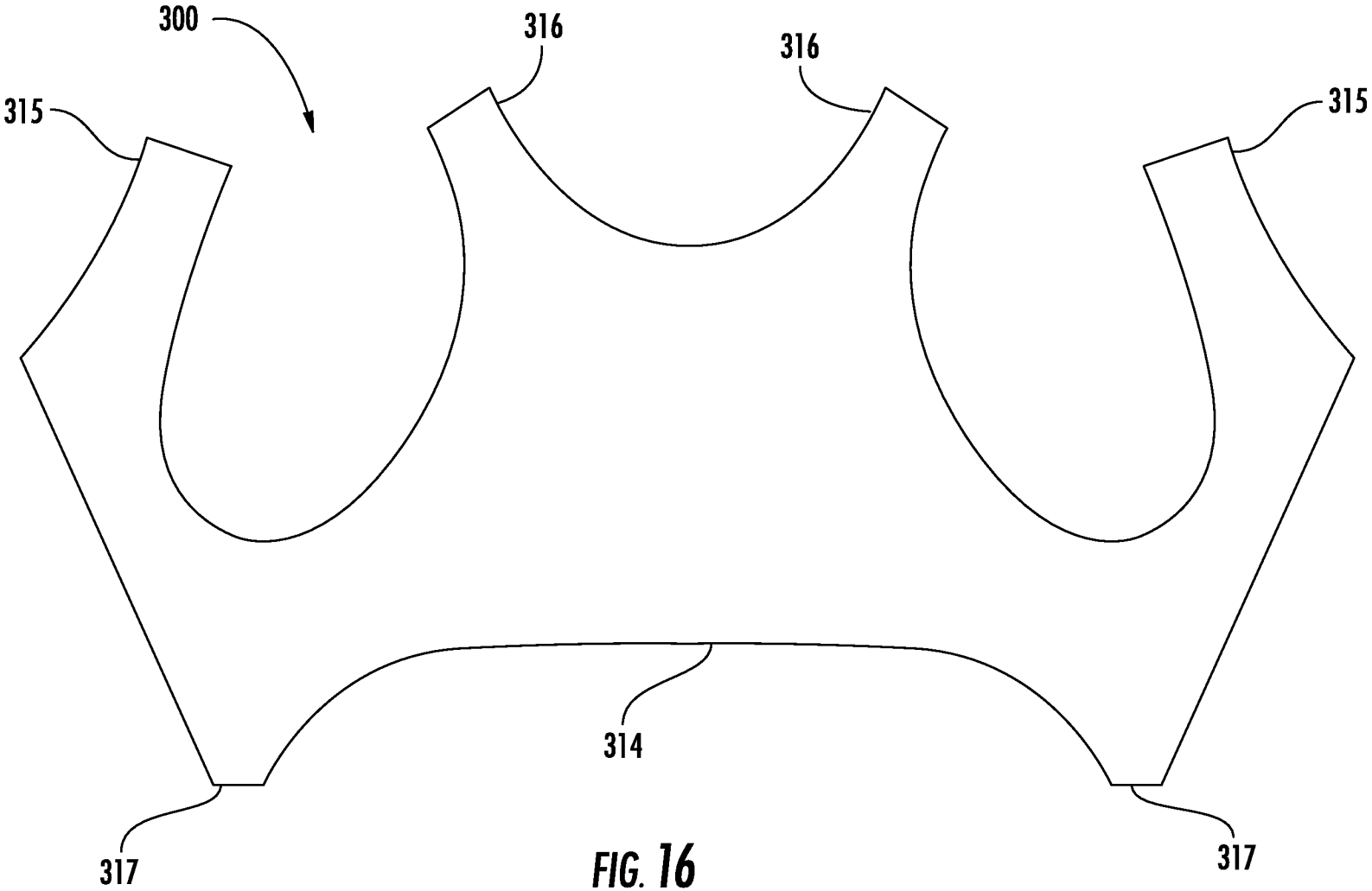
FIG. 16 is a plan view of a pattern for an example of an integrated waistband positioning system.
Figure 17:
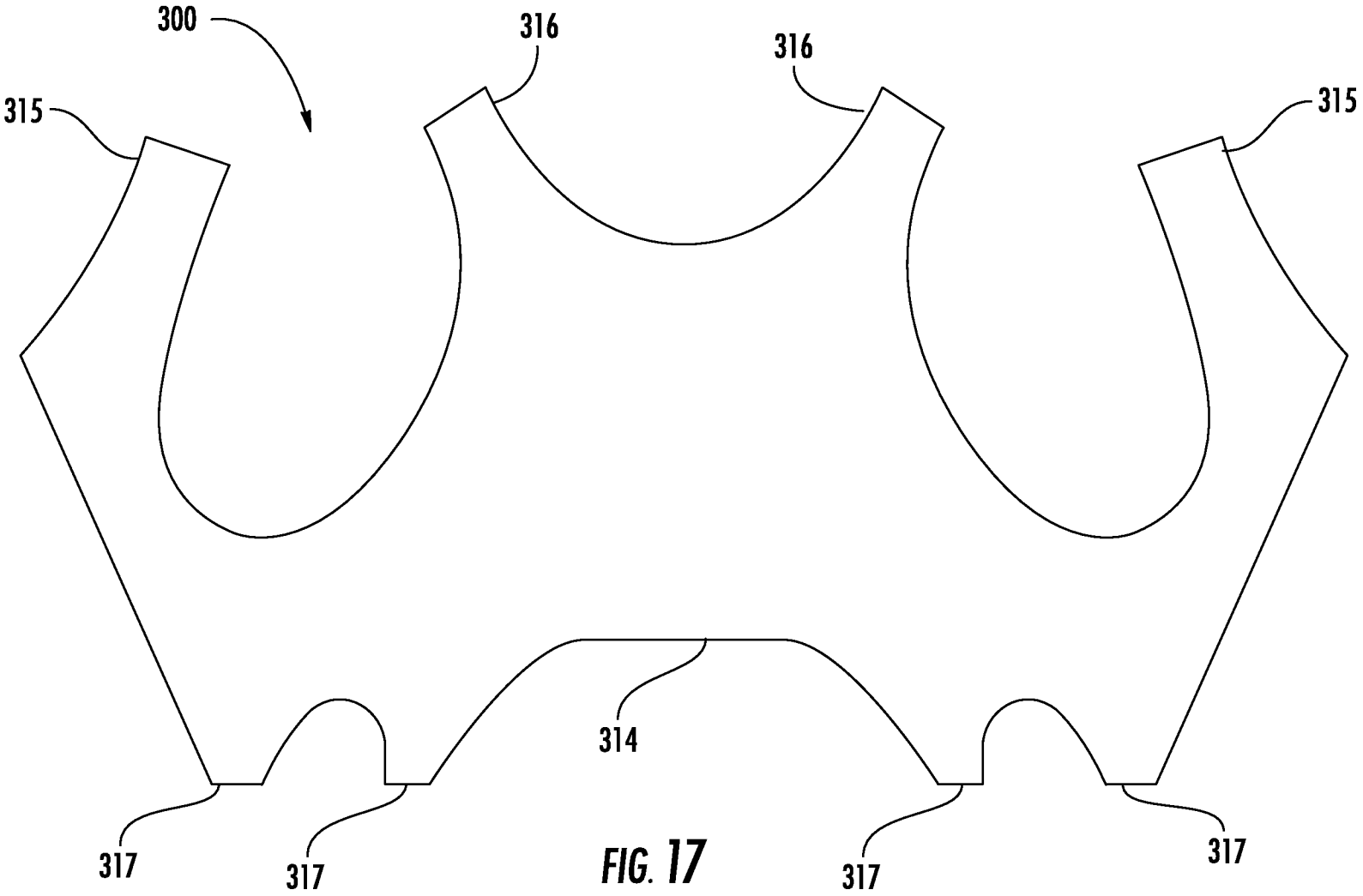
FIG. 17 is a plan view of a pattern for an example of an integrated waistband positioning system.
Figure 18:
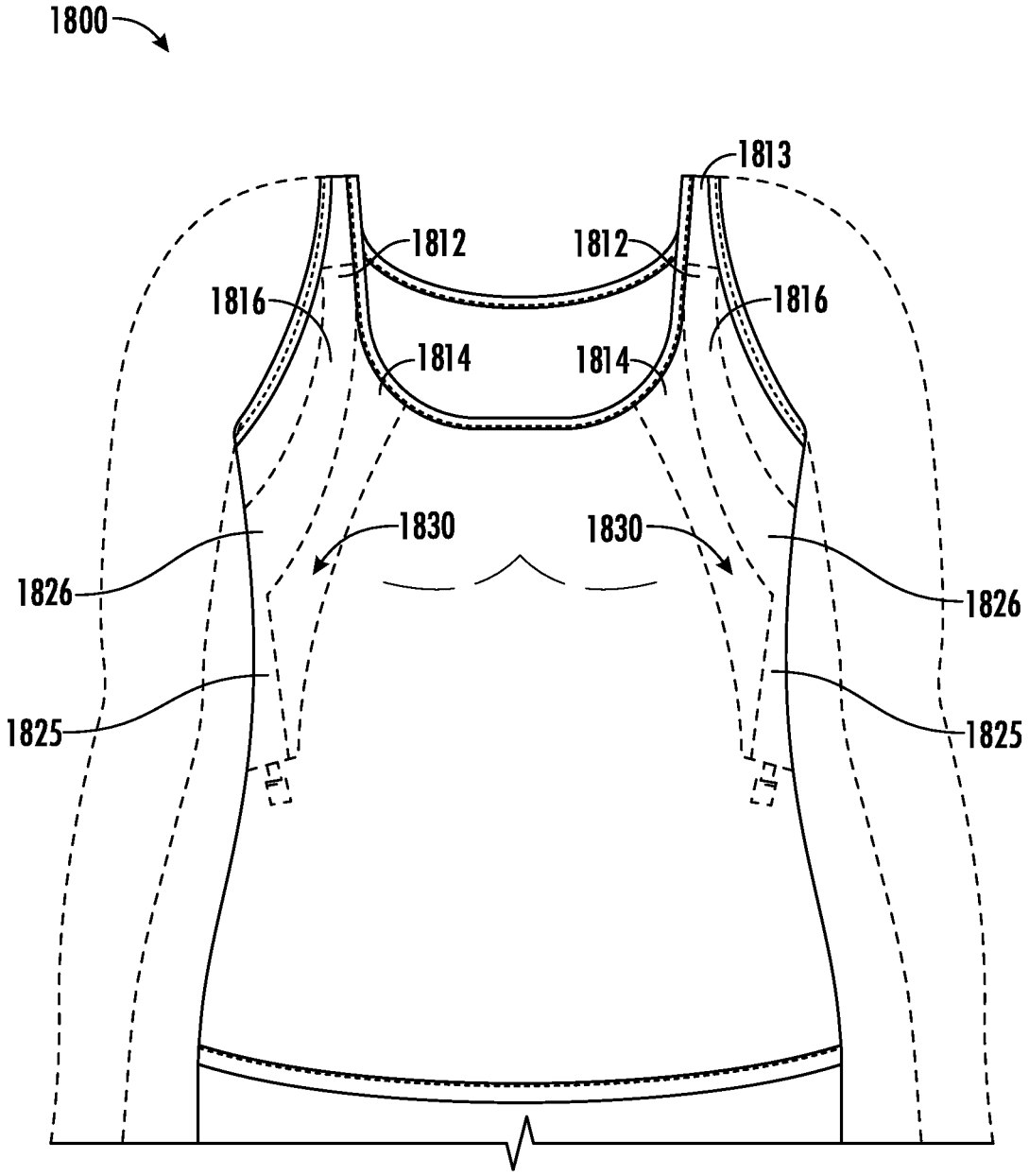
FIG. 18 is a front view of a garment assembly with an integrated waistband positioning system an example of the current disclosure.
Figure 19:
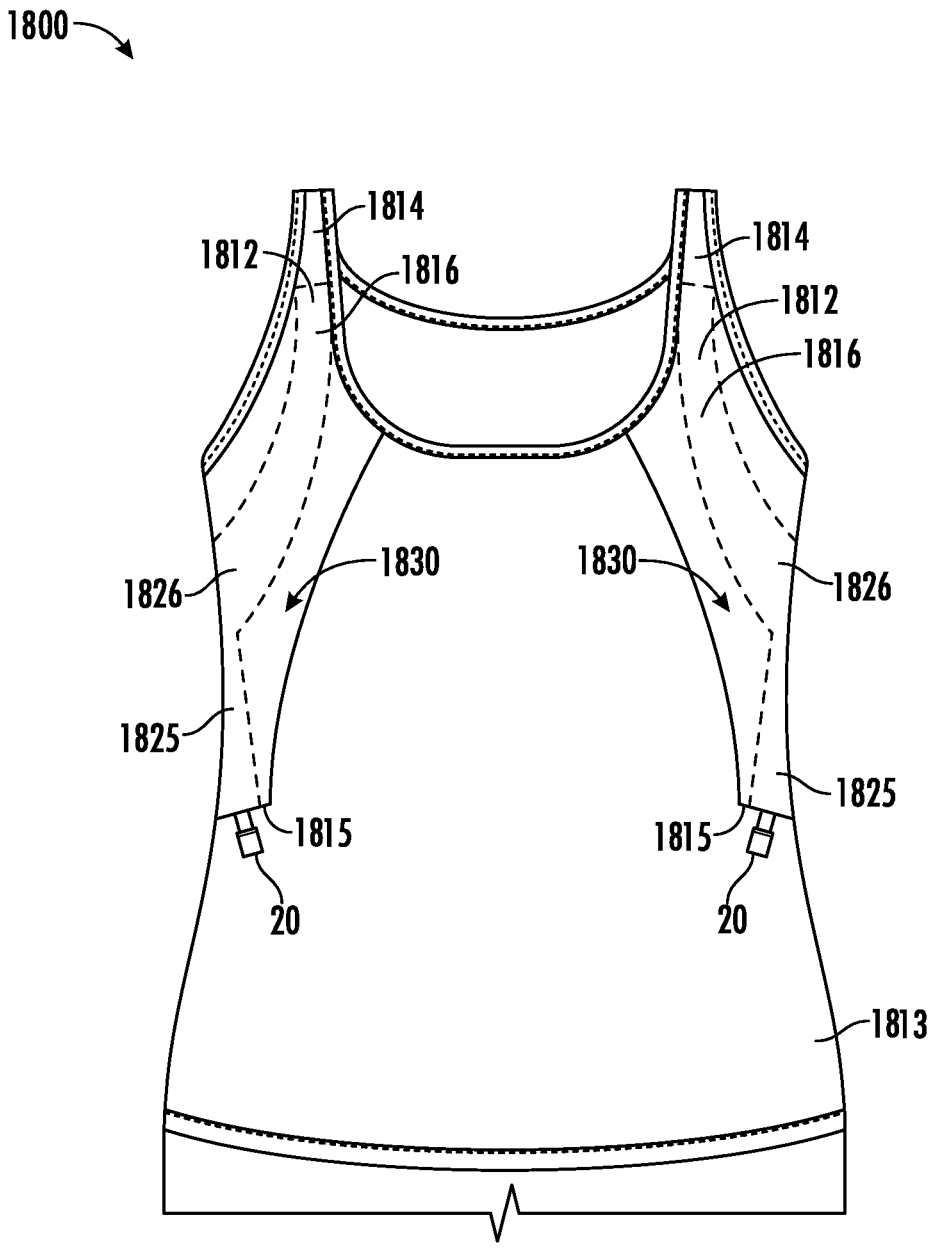
FIG. 19 is a front view of the garment assembly of FIG. 18 in an inside-out configuration.

FIGS. 16 and 17 are plan views of a pattern 300 used to form a demi-vest waistband positioning system, such as waistband positioning system 412 described above. The pattern 300 includes a rear section 314 positioned between force distribution area contours 317. As shown in FIG. 16, the pattern 300 may have two force distribution area contours 317. However, the pattern 300 may also have four force distribution area contours 317, as shown in FIG. 17, or any number as required for a particular example of the waistband positioning system. As shown in FIGS. 16 and 17, the pattern 300 also includes front shoulder portion segment contours 315 and rear shoulder portion segment contours 316. After using the pattern 300 to create an unfinished waistband positioning system from a suitable material, the front shoulder portion segment contours 315 and rear shoulder portion segment contours 316 of the unfinished waistband positioning system may be sewn or otherwise attached to one another to form shoulder portions, such as shoulder portions 416 described above. The unfinished waistband positioning system may then have additional features attached to form a finished waistband positioning system, such as distal ends and associated hardware as described above.

The assembled waistband positioning system and associated hardware may then be used either as a standalone garment, integrated into an article of clothing during manufacture to form a garment assembly, or as a retrofit device. In certain examples, the pattern 300, or portions of the pattern 300, may be used to make smaller portions of the unfinished garment assembly, which may or may not have similar colors, weaves, or other properties. These portions may then be joined together to form the completed waistband positioning system. Alternatively, the waistband positioning system may be manufactured out of a single piece of suitable material.

FIGS. 18-22 illustrate an example of a garment assembly 1800 having one or more waistband positioning systems 1812 and inner panels 1814. The illustrated example includes two waistband positioning systems 1812, although fewer or more could be included. The inner panels 1814 are adjacent an inner surface of an outer layer 1813 of the garment assembly 1800. Similar to the outer layer 413, the outer layer 1813 may be part of a shirt, tank top, camisole, bra, or any other article of clothing intended to be worn on the upper body. In various examples, the outer layer 1813 may be a single panel or may be comprised of multiple panels or portions joined together. In the illustrated example, the outer layer 1813 is made up of two pieces jointed together. The outer layer 1813 covers and conceals the one or more waistband positioning systems 1812, which may be positioned proximate an inner surface of the outer layer as described in detail below. The inner panels 1814 and outer layer 1813 may be integral with, fashioned from the same piece of material, or may be separable from each other and/or from an article of clothing. In various examples, the inner panels 1814 are secured to the outer layer 1813 such that a channel 1830 is formed between each inner panel 1814 and the outer layer 1813, respectively. As described in detail below, the channel 1830 is configured to accommodate a range of motion of the waistband positioning system 1802 from a front of the garment to a back of the garment and further accommodates independent movement of the waistband positioning system 1802 relative to the garment and the outer layer 1813 in particular. In some examples, the channel 1830 may extend over a user's shoulder, although it need not.

In some examples, the inner panels 1814 are secured to the inner surface of the outer layer 1813. As illustrated in FIGS. 18-21, in various examples, the inner panels 1814 may be secured at various locations on the outer layer 1813, including, but not limited to, along an arm hole area and/or along a neckline area and/or proximate a shoulder area, among others. The locations where the inner panels 1814 are secured to the outer layer 1813 may vary depending on the type of article of clothing that the outer layer 1813 is a part of. The inner panels 1814 may be secured to the outer layer 1814 through any suitable securing mechanism including, but not limited to, hook and loop fasteners, sewing, stitching, adhesives, buttons, clips, and various other suitable securing mechanisms.

As illustrated in FIGS. 19-22, in various examples, each inner panel 1814 has an edge 1815 that is detached from the outer layer 1813. In some examples, the edge 1815 is a bottom edge of the inner panel 1814, although it need not be. In some examples, each edge 1815 defines a channel opening providing access to the channel 1830 at each edge 1815 between the inner panel 1814 and the outer layer 1813.

As shown in FIGS. 19-22, in some examples, the edge 1815 is at a portion of the inner panel 1814 that is distal from the arm hole area and the neckline area, although it need not be. In various cases, the edge 1815 and corresponding channel opening are oriented such that the waistband positioning system 1812 may extend through the channel opening towards a waist area of a user. In some examples, as illustrated in FIGS. 19-22, a length of the inner panel 1814 is less than a length of the garment such that the edge 1815 and a bottom edge of the outer panel 1814 are not adjacent to each other. In other examples, the length of the inner panel 1814 may be approximately the same as the length of the garment such that the edge 1815 is approximately adjacent to the bottom edge of the outer panel 1814.

The waistband positioning system 1802 includes a main portion 1826, a force distribution area 1825, and a shoulder portion 1816. In some optional examples, the waistband positioning system 1802 or particular components of the waistband positioning system 1802 may be removable and detachable. The materials used to construct the various components of the waistband positioning system 1802 may be similar to those described above with reference to the waistband positioning systems 12, 112, 212, and 412. Similar to the waistband positioning systems 12, 112, 212, and 412, the number of force distribution areas 1825 or shoulder portions 1816 extending from the main portion 1826 can vary. For example, in some cases, such as those illustrated in FIGS. 18-22, the waistband positioning system 1802 includes two shoulder portions 1816 and one force distribution area 1825 extending from the main portion 1826 such that the waistband positioning system is generally "Y"-shaped. In other examples, as described in detail below with reference to FIG. 23, each waistband positioning system includes one shoulder portion 1816 that forms a loop (or two connected shoulder portions 1816 that together form a loop) and one force distribution area 1825, both extending from the main portion 1826, such that the waistband positioning system is generally "Q"-shaped or has a holster-type shape configured to wrap around a user's shoulder. Various other combinations of force distribution areas 1825 and shoulder portions 1816 may be utilized.

In some examples, the ends of the shoulder portions 1816 distal from the main portion 1826 have a width that is greater than a width of areas of the shoulder portions 1816 proximate to the main portion 1826, although they need not. However, similar to the force distribution areas 25,125, and 425, the force distribution areas 1825 may have any suitable shape or configuration. A distal end 1818 of each force distribution area 1825 may include fasteners, such as the clips 20, or other suitable fasteners including, but not limited to, snaps, buttons, hook and loop fasteners, magnets, or various other suitable fasteners. In some examples, the force distribution areas 1825 may optionally include adjusters similar to the adjusters 22.

The waistband positioning system 1802 is positioned such that at least a portion of the system is within the channel 1830. In some examples, the main portion 1826, the shoulder portions 1816, and a portion of the force distribution area 1825 are located within the channel 1830, and the end 1818 or clip 20 extends through the channel opening and beyond the edge 1815 of the inner panel 1814. In other examples, the entire waistband positioning system 1802 is within the channel 1830 until the waistband positioning system 1802 is utilized and a user pulls the clip 20 through the channel opening.

In various examples, the inner panel 1814 optionally defines a through hole or other opening that provides access to the channel 1830 and that the waistband positioning system 1802 may extend through. In these examples, the bottom edge of the inner panel 1814 may optionally be secured to the outer layer 1813, and an edge of the through hole may correspond to the edge 1815. In such cases, the portion of the channel 1830 extending from the through hole to the bottom edge may be a pocket in which the waistband positioning system 1802 may be stored or secured when not in use. In some examples, the channel 1830 includes a pocket for storing the waistband positioning system 1802 when not in use, but does not include a through hole.

Figure 21:
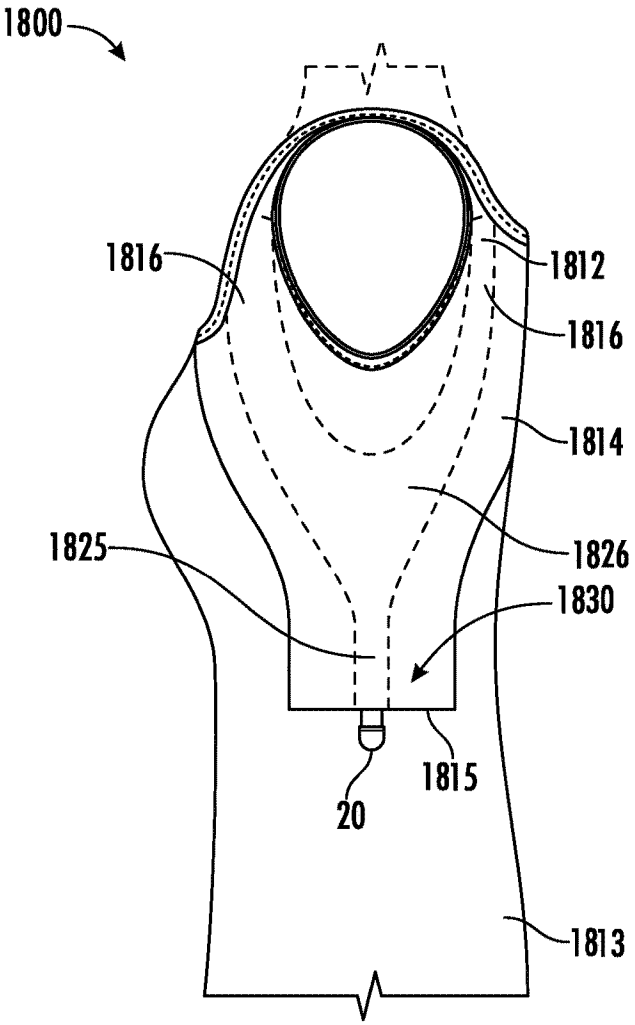
FIG. 21 is a side view of the garment assembly of FIG. 18 in an inside-out configuration.
Figure 20:
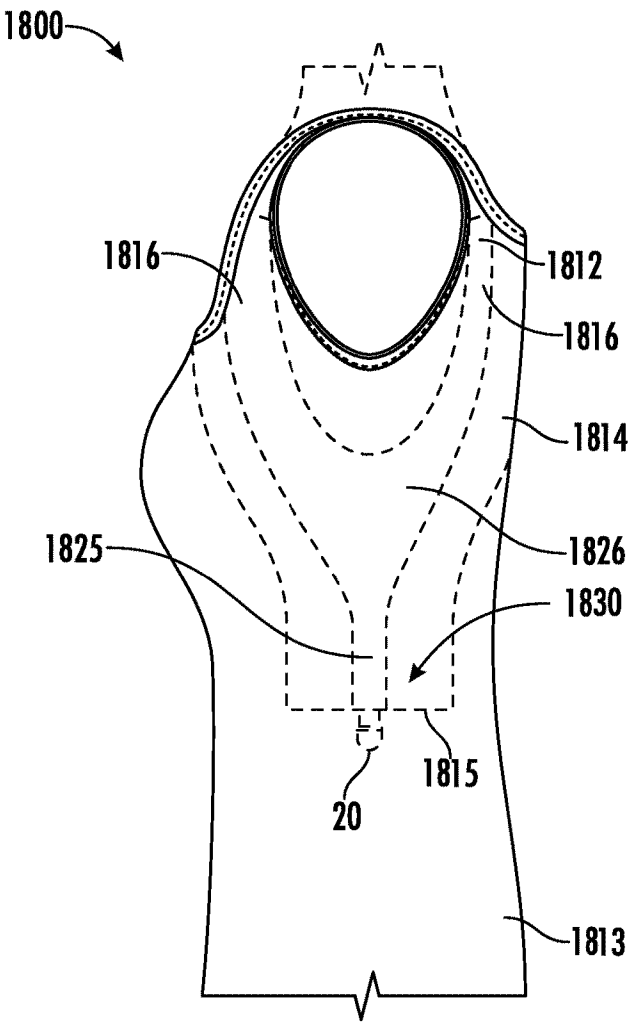
FIG. 20 is a side view of the garment assembly of FIG. 18.
Figure 22:
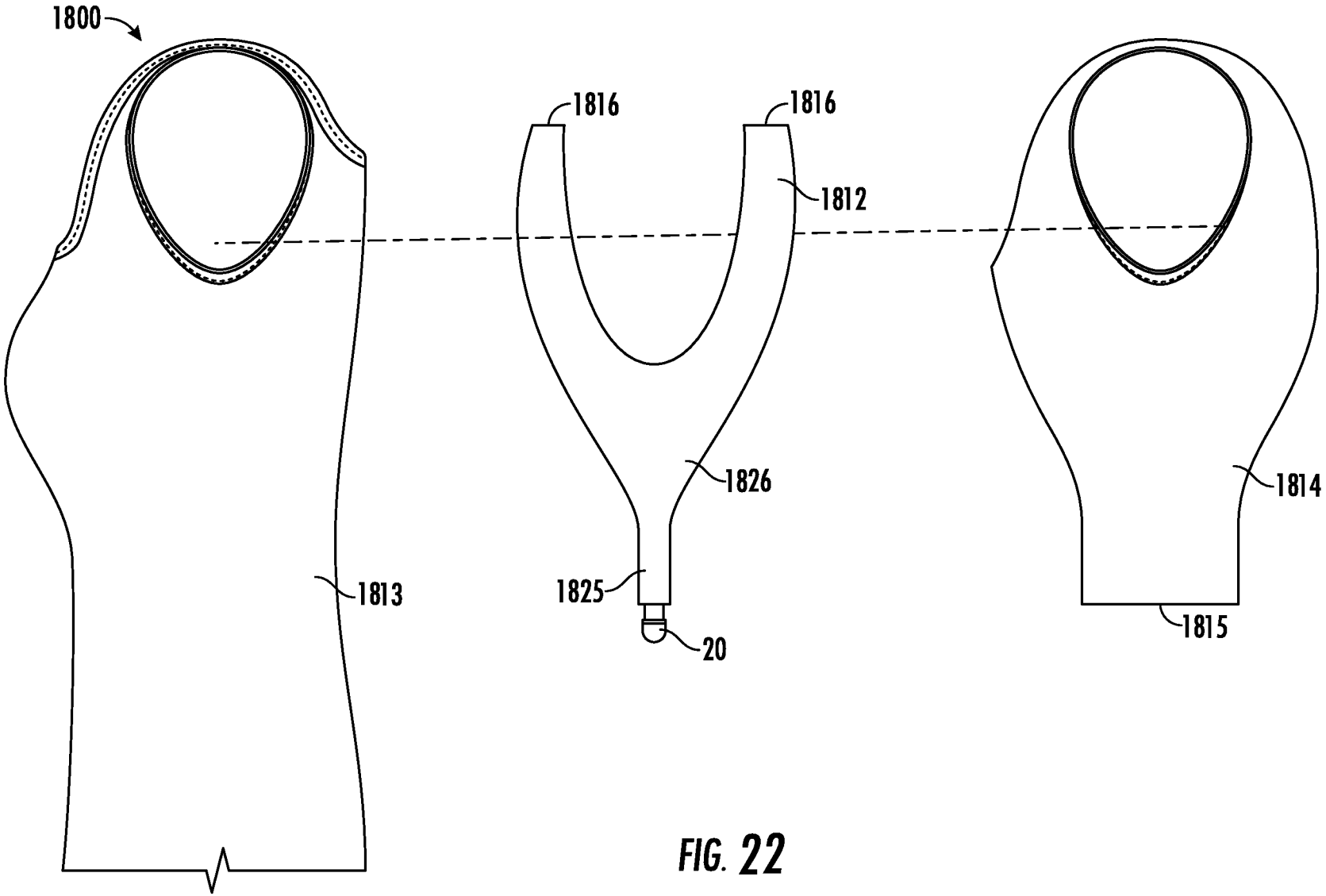
FIG. 22 is an exploded assembly view of the garment assembly of FIG. 18.

In some examples, the waistband positioning system 1802 is secured through the shoulder straps 1816 proximate to a shoulder of the user when worn. For example, in some cases as illustrated in FIGS. 18-21, the ends of the shoulder portions 1816 distal from the main portion 1826 may be secured to the inner panel 1814 and/or the outer layer 1813 through stitching, sewing, fasteners, or various other securing mechanisms. In some non-limiting examples, the ends of the shoulder portions 1816 may be secured at the neckline area of the outer layer 1813 and/or the arm hole area of the outer layer 1813, although they need not be. For example, in some non-limiting cases, the inner panels 1814 may be secured into and along at least a portion of a seam or other edge of the garment, including, but not limited to, a portion of a neckline seam, a portion of an arm hole seam, and other areas. In some examples, as illustrated in FIGS. 20 and 21, the shoulder portions 1816 may be secured at both a front side and a back side of the garment formed by the outer layer 1813. In these examples, the shoulder portions 1816 may be secured at opposite sides of the arm hole area of the outer layer 1813, although they need not be. As illustrated in FIGS. 20 and 21, the waistband positioning system 1802 is positioned within the channel 1830 such that the main portion 1826 and force distribution area 1825 are below the arm hole area of the outer layer 1813. In some cases, the main portion 1826 and the force distribution area 1825 are directly below the arm hole area of the outer layer 1813.

In other examples, such as those where a shoulder portion 1816 defines a loop that is configured to extend over a user's shoulder, the shoulder portions 1816 may be supported by the user's shoulder within the channel 1830 without being secured to the inner panel 1814 and/or the outer layer 1813, although it need not be. For example, in some cases where the shoulder portion(s) 1816 forms the loop, the shoulder portion(s) 1816 may be secured at one or more locations on the outer layer 1813, including, but not limited to, at or above the neckline area and/or the arm hole area of the outer layer 1813. In some examples, the edges of the main portion 1826 and the force distribution area 1825 are open edges that are not secured to the outer layer 1813. In these examples, the main portion 1826 and the force distribution area 1825 move freely and independently of the outer layer 1813 and are indirectly connected to the outer layer 1813 and/or inner layer 1814 through the shoulder portions 1816. Not attaching the main portion 1826 and the force distribution area 1825 with the outer layer 1813 prevents the outer layer 1813 from sagging or being pulled down by the waistband positioning system 1802 and other uncomfortable and/or unsightly effects.

In some cases, the waistband positioning system 1802 may optionally be attached to the inner panel 1814 proximate to the edge 1815 through a bridge portion. For example, in some cases, the bridge portion may be a portion of the force distribution area 1825 that is secured to the inner panel 1814 proximate to the edge 1815 of the inner panel 1814. For example, the bridge portion may be a piece of elastic material. In various examples, the bridge portion may have a folded orientation that is configured to unfold and refold as the waistband positioning system 1802 is being utilized by the user, although it need not. In these examples, the waistband positioning system 1802 may move freely and independently from the outer layer 1813. The waistband positioning system 1802 also remains in its general orientation such that the clip 20 (or other securing mechanism) does not recede further up the channel 1830 or migrate out of reach of the user, which may otherwise occur, for example, after the garment has been washed. In other examples, various other mechanisms may be utilized to attach the waistband positioning system to the inner panel 1814 and/or to help the waistband positioning system 1802 retain its configuration while being freely and independently movable, including, but not limited to, various tethers, elastic strips, panels, or various other suitable mechanisms.

The arrangement of the waistband positioning system 1802 relative to the outer layer 1813 and inner panel 1814 allow the waistband positioning system 1802 to deflect and move freely and independently of the outer layer 1813 and the inner panel 1814, thereby distributing forces over an area and to the outer layer 1813, similar to the garment assemblies 100, 200, and 400. In some examples, by positioning the waistband positioning system 1802 within the channel 1830, direct contact between the waistband positioning system 1802 and the user during movement of the waistband may be at least partially avoided, thereby providing more comfort for the user.

Figure 23:
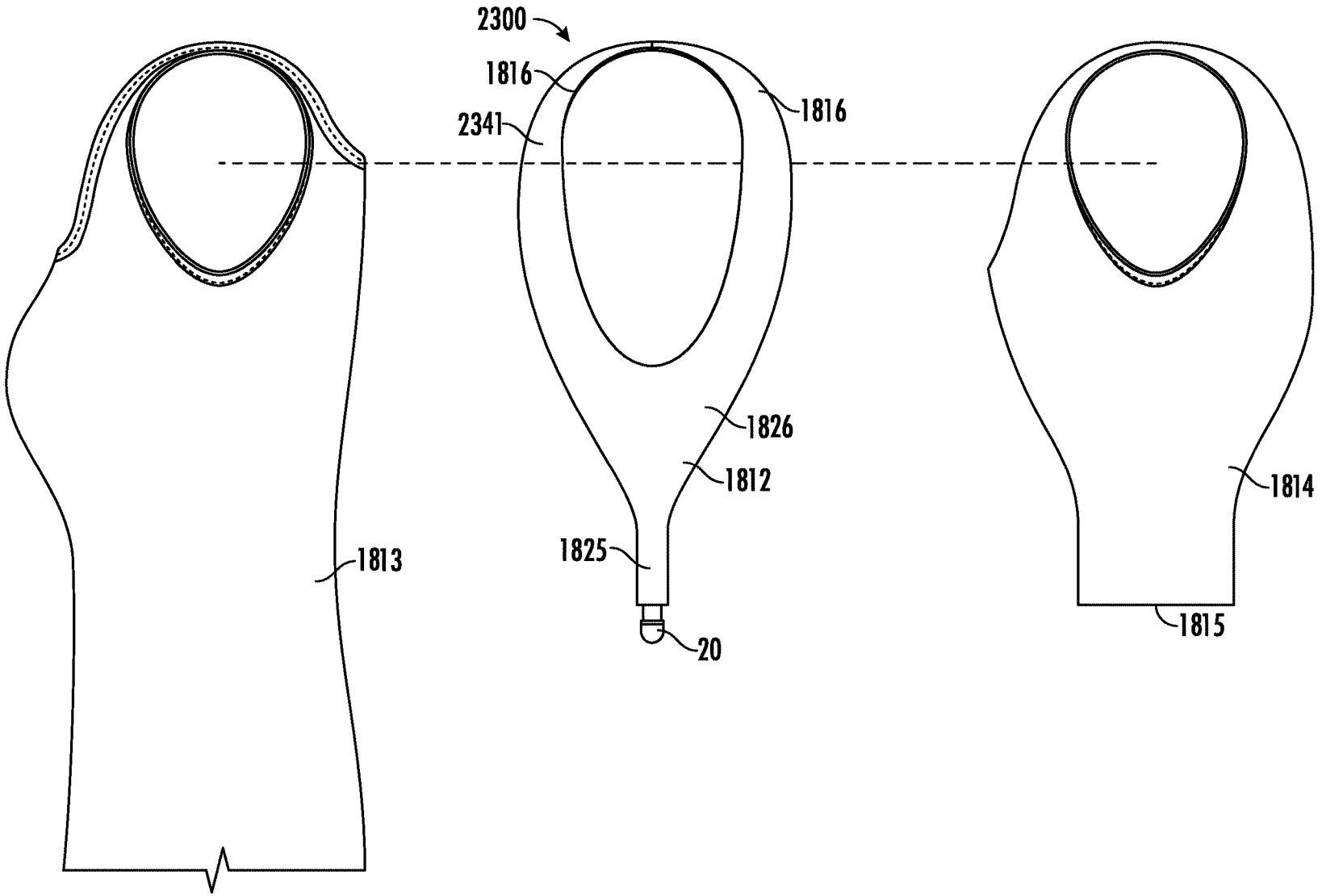
FIG. 23 is an exploded assembly view of a garment assembly with an integrated waistband positioning system an example of the current disclosure.

FIG. 23 illustrates an example of a garment assembly 2300 having one or more waistband positioning systems 2312. The waistband positioning system 2312 is similar to the waistband positioning system 1812, except that the shoulder portions 1816 have been joined to form a loop 2341 configured to extend over a user's shoulder when the garment assembly 2300 is worn. In some examples, the shoulder portions 1816 are sewn together, although any suitable joining mechanism may be used. As described above, in other examples, a single shoulder portion 1816 may form the loop 2341 instead of securing two shoulder portions 1816 together.

Different arrangements of the components depicted in the drawings or described above, as well as components and steps not shown or described are possible. Similarly, some features and subcombinations are useful and may be employed without reference to other features and subcombinations. Examples of the invention have been described for illustrative and not restrictive purposes, and alternative examples will become apparent to readers of this patent. Accordingly, the present invention is not limited to the examples described above or depicted in the drawings, and various examples and modifications can be made without departing from the scope of the claims below.

That which is claimed is:

1. An upper-body garment assembly comprising:

an outer layer comprising an inner surface and an outer surface;

an inner panel secured to the inner surface of the outer layer and covering a portion of the inner surface of the outer layer, the inner panel defining a channel between the inner surface of the outer layer and the inner panel, and an independent edge of the inner panel defining a channel opening between the outer layer and the inner panel; and a waistband positioning system positioned substantially within the channel, the waistband positioning system comprising:

a main portion; and a force distribution area extending from the main portion, the force distribution area having an end distal from the main portion, the end comprising a fastener extendable through the channel opening and the end independently movable relative to the outer layer and the inner panel.

2. The upper-body garment assembly of claim 1, wherein the waistband positioning system comprises a four-way stretch material that stretches both crosswise and lengthwise.

3. The upper-body garment assembly of claim 1, further comprising a first shoulder portion extending from the main portion, wherein the upper-body garment assembly further comprises a second shoulder portion extending from the main portion, and wherein each of the first shoulder portion and the second shoulder portion comprise an end distal from the main portion.

4. The upper-body garment assembly of claim 1, further comprising a first shoulder portion extending from the main portion, wherein the first shoulder portion comprises an end distal from the main portion and an area proximate to the main portion, wherein a width of the area proximate to the main portion is less than a width of the end distal from the main portion.

5. The upper-body garment assembly of claim 1, further comprising at least one shoulder portion extending from the main portion, wherein the at least one shoulder portion defines a loop configured to extend over a user's shoulder.

6. The upper-body garment assembly of claim 1, further comprising at least one shoulder portion extending from the main portion, wherein the at least one shoulder portion of the waistband positioning system is secured to at least one of the outer layer or the inner panel proximate to a shoulder portion of the outer layer.

7. The upper-body garment assembly of claim 6, wherein the at least one shoulder portion of the waistband positioning system is secured to at least one of the outer layer or the inner panel.

8. The upper-body garment assembly of claim 6, wherein the at least one shoulder portion of the waistband positioning system is secured at a neck line of the outer layer.

9. The upper-body garment assembly of claim 1, wherein the force distribution area is a first force distribution area, and wherein the upper-body garment comprises a second force distribution area.

10. The upper-body garment assembly of claim 1, wherein the inner panel is secured to the outer layer such that the independent edge of the inner panel defines the channel opening distal from an arm hole of the outer layer.

11. The upper-body garment assembly of claim 1, wherein the outer layer is one of a brassiere, a camisole, a shirt, a sports bra, or a tank top.

12. An upper-body garment assembly comprising:

an outer layer comprising an inner surface and an outer surface;

an inner panel secured to the inner surface of the outer layer and covering a portion of the inner surface of the outer layer, the inner panel defining a channel between the outer layer and the inner panel, and an independent edge of the inner panel defining a channel opening between the outer layer and the inner panel; and a waistband positioning system positioned substantially within the channel, the waistband positioning system comprising:

a main portion positioned within the channel; and a force distribution area extending from the main portion, the force distribution area having an end distal from the main portion, the end comprising a fastener positionable exterior to the channel and the end being independently movable relative to the outer layer and the inner panel.

13. The upper-body garment assembly of claim 12, wherein the outer layer is one of a brassiere, a camisole, a shirt, a sports bra, or a tank top.

14. The upper-body garment assembly of claim 12, wherein the main portion of the waistband positioning system is independently movable relative to the outer layer and the inner panel.

15. The upper-body garment assembly of claim 12, wherein the waistband positioning system comprises four-way stretch material that stretches both crosswise and lengthwise.

16. The upper-body garment assembly of claim 12, further comprising at least one shoulder portion extending from the main portion, wherein the at least one shoulder portion is a first shoulder portion, wherein the upper-body garment assembly further comprises a second shoulder portion extending from the main portion, and wherein each of the first shoulder portion and the second shoulder portion comprise an end distal from the main portion.

17. The upper-body garment assembly of claim 12, further comprising at least one shoulder portion extending from the main portion, wherein the at least one shoulder portion comprises an end distal from the main portion and an area proximate to the main portion with a width that is less than a width of the end distal from the main portion.

18. The upper-body garment assembly of claim 12, further comprising at least one shoulder portion extending from the main portion, wherein the at least one shoulder portion defines a loop configured to extend over a user's shoulder.

19. The upper-body garment assembly of claim 12, wherein the inner panel is secured to the outer layer such that the independent edge of the inner panel defines the channel opening distal from an arm hole of the outer layer.

20. The upper-body garment assembly of claim 12, further comprising at least one shoulder portion extending from the main portion, wherein the at least one shoulder portion of the waistband positioning system is secured to at least one of the outer layer or the inner panel proximate to a shoulder portion of the outer layer.

* * * * *